US007396122B2

(12) United States Patent
Masumi et al.

(10) Patent No.: US 7,396,122 B2
(45) Date of Patent: Jul. 8, 2008

(54) IMAGE RECORDING DEVICE

(75) Inventors: Satoshi Masumi, Hino (JP); Tetsu Sekine, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 472 days.

(21) Appl. No.: 10/807,302

(22) Filed: Mar. 24, 2004

(65) Prior Publication Data

US 2004/0189773 A1 Sep. 30, 2004

(30) Foreign Application Priority Data

Mar. 25, 2003 (JP) ..... 2003-082857
Feb. 13, 2004 (JP) ..... 2004-036908

(51) Int. Cl.
*B41J 2/01* (2006.01)

(52) U.S. Cl. ..... 347/102; 347/101

(58) Field of Classification Search ..... 347/102, 347/101; 101/488; 219/216; 346/25; 399/320
See application file for complete search history.

(56) References Cited

U.S. PATENT DOCUMENTS 3,881,942 A * 5/1975 Buckwalter ..... 106/31.86
4,517,893 A * 5/1985 Wile et al. ..... 101/123
5,502,464 A * 3/1996 Takahashi et al. ..... 346/25
5,936,008 A * 8/1999 Jones et al. ..... 523/161
6,004,052 A * 12/1999 Muranaka ..... 400/636
6,092,891 A * 7/2000 Okubo et al. ..... 347/104
6,149,327 A * 11/2000 Ward et al. ..... 400/582
6,312,123 B1 * 11/2001 Codos et al. ..... 347/102
6,523,948 B2 * 2/2003 Matsumoto et al. ..... 347/102
6,820,975 B2 * 11/2004 Sugaya et al. ..... 347/104
2002/0008747 A1 * 1/2002 Kaga et al. ..... 347/102
2003/0137572 A1 * 7/2003 Miyamoto et al. ..... 347/102

FOREIGN PATENT DOCUMENTS

JP 01026486 A * 1/1989
JP 07-224241 8/1995
JP 2000-117960 4/2000
JP 2003072239 A * 3/2003

* cited by examiner

*Primary Examiner*—Stephen D. Meier
*Assistant Examiner*—Leonard S Liang
(74) *Attorney, Agent, or Firm*—Finnegan, Henderson, Farabow, Garrett & Dunner, L.L.P.

(57) ABSTRACT

An image recording device, comprises: a recording head which discharges an ultraviolet-ray curable ink, which is cured as irradiated with ultraviolet rays; an ultraviolet light source which generates ultraviolet rays to cure the ultraviolet-ray curable ink; a first heating section which heats the ultraviolet-ray curable ink on a recording medium after an irradiation of the ultraviolet rays; a pressure section which pressurizes the recording medium after an irradiation of the ultraviolet rays; and a controller which controls the first heating section to start heating the ultraviolet-ray curable ink on the recording medium after the last discharge of the ink to an arbitrary area on the recording medium, a first predetermined time between the last discharge and the starting heat is predetermined, and controls the first heating section to heat the ultraviolet-ray curable ink within a second predetermined time.

20 Claims, 17 Drawing Sheets

IMAGE RECORDING DEVICE

BACKGROUND OF THE INVENTION

1. Field of the Invention

The present invention relates to an image recording device that discharges a photo-setting ink to form images and a method for recording images.

2. Description of the Related Art

The ink jet recording systems include several recording methods those which use various types of ink, such as water-soluble ink, oil-soluble ink, solvent-soluble ink and ultraviolet-ray curable ink, respectively.

In recent years, the ink jet recording system of the active energy ray curing type has come into the spotlight as an image forming method that can form images even on a base material which poorly absorbs ink. As such an ink, there are two types, namely, one is the solvent type in which a reactive monomer is diluted in water, a water-soluble solvent or an organic solvent selected from various organic solvents and the non-solvent type with which no solvent remains after curing thereof. Among those inks, an ink prepared by diluting a reactive monomer with water is recently in the spotlight in view of tendency of favoring free of volatile organic compositions (VOC), easiness in the preparation of ink and safety issues. In particular, the ink of a type that contains non-volatile water-soluble solvent is in the spotlight because, once the dehydration property of this type of ink has been improved, the curing property thereof will be improved accordingly, whereby it is expected that improvement in the high-speed printing and thus high printing productivity can be realized with this type of ink.

However, on the other hand, in addition to high productivity, there has been coming up also with a need to print images on a paper, such as a copying paper, that is not provided with an ink-image forming layer. As a result, further demands for improving the curing performance of the ink have been raised.

As such an ink of the active energy ray curable type, aqueous inks of the ultraviolet-ray curable type are desirably used. In order to improve the curing performance of such aqueous inks, it is proposed, for example, JP Tokukaihei 7-224241), where the cationic polymerization system is employed, to heat an aqueous ink for 5 to 30 min. at a temperature in a range of 80° C. to 170° C. to thereby achieve the curing and dehydration of the ink in a short period of time (see the paragraph of [0022] in JP Tokukaihei 7-224241).

Besides, a printing method that allows to improve the dehydration performance of an ink is disclosed in JP Tokukai 2000-117960. In this reference, a recording medium that has a given wetting characteristic with pure water and satisfies a property with regard to the absorbable ink volume and an ink to be used for the recording medium are taught (see the paragraphs [0008] to [0010] of JP Tokukai 2000-117960). Furthermore, it is described in this reference that the ink comprising the predetermined materials must be used and a step for removing the used solvent must be included, when an aqueous ink comprising an ultraviolet-ray curable substance was used. Besides, in this step for removing the used solvent, it is described that any of evaporation, drying by heating and washing with water can be employed (see the paragraph [0028] of JP Tokukai 2000-117960), and it is specifically described that washing with water is employed in case of the recording medium that has resistance against heating by means of a microwave oscillator, a far infrared lamp or the like and water (see the paragraph [0075] of JP Tokukai 2000-117960).

By the way, in JP Tokukaihei 7-224241 mentioned above, there is no description on the specific heating section and method for curing and dehydrating the ink in a short period of time and on the improvement of the dehydration performance of the ink.

On the other hand, in JP Tokukai 2000-117960 mentioned above, it is described that a predetermined heating method is carried out in order to improve the dehydration performance of an aqueous ultraviolet-ray curable ink. However, according to that method, there has been such a fear that, if too much severe condition was applied for the dehydration and a recording medium with less strength like a copying paper was used when more faster high-speed printing was required, the recording medium may be folded to cause a trouble in the course of moving the recording medium.

SUMMARY OF THE INVENTION

Therefore, the present invention is aiming at solving the problem as described above, and it is an object of the present invention to provide an image recording device and a method for recording images, which allow to realize high printing productivity with the use of an ink jet recording device using a solvent system, in particular, an active energy ray curable ink containing water and enable to record images without causing folds of a recording medium and troubles in the course of moving the recording medium, which may happen during high-speed printing.

In order to achieve the above-described object of the present invention, in accordance with a first aspect of the present invention, an image recording device, comprises:

a recording head which discharges an ultraviolet-ray curable ink, which is cured as irradiated with ultraviolet rays;

an ultraviolet light source which generates ultraviolet rays to cure the ultraviolet-ray curable ink;

a first heating section which heats the ultraviolet-ray curable ink on a recording medium after an irradiation of the ultraviolet rays;

a pressure section which pressurizes the recording medium after an irradiation of the ultraviolet rays; and a controller which controls the first heating section to start heating the ultraviolet-ray curable ink on the recording medium after the last discharge of the ink to an arbitrary area on the recording medium, a first predetermined time between the last discharge and the starting heat is predetermined, and controls the first heating section to heat the ultraviolet-ray curable ink within a second predetermined time.

It is preferable that the first predetermined time is in a range between 0.1 and 120 seconds.

It is preferable that the second predetermined time is in a range between 0.1 and 10 seconds.

It is preferable that the controller changes a heat quantity, which is applied to the ink by the heating section, in accordance with kinds of recording medium to be recorded.

It is preferable that the controller changes the second predetermined time in accordance with kinds of recording medium to be recorded.

It is preferable that the controller changes the first predetermined time in accordance with kinds of recording medium to be recorded.

It is preferable that the controller changes a heat quantity, which is applied to the ink by the heating section, in accordance with recording conditions.

It is preferable that the controller changes the second predetermined time in accordance with recording conditions.

It is preferable that the controller changes the first predetermined time in accordance with recording conditions.

It is preferable that the heating section is used as the pressure section.

It is preferable that a heating process of the heating section and a pressurize process of the pressure section is overlapped.

It is preferable that the image recording device further comprises a second heating section which heats the ultraviolet-ray curable ink on the recording medium after an heating process of the first heating section.

It is preferable that the image recording device further comprises a third heating section which heats the recording medium before an heating process of the first heating section.

It is preferable that the image recording device further comprises a moving section which relatively moves the recording medium to the first heating section.

It is preferable that the moving section includes:

a pair of rollers which moves the recording medium to the first heating section, wherein one of the rollers is used as the heating section, and the other is used as the pressure section.

It is preferable that the moving section includes:

a roller and a belt which move the recording medium to the first heating section, wherein one of the roller and the belt is used as the heating section, and the other is used as the pressure section.

It is preferable that the moving section includes:

a pair of belts which moves the recording medium to the first heating section, wherein one of the belts is used as the heating section, and the other is used as the pressure section.

In accordance with a second aspect of the present invention, an image recording device, comprises:

a recording head which discharges an ultraviolet-ray curable ink, which is cured as irradiated with ultraviolet rays;

an ultraviolet light source which generates ultraviolet rays to cure the ultraviolet-ray curable ink;

a first heating section which heats the ultraviolet-ray curable ink on a recording medium after an irradiation of the ultraviolet rays;

a pressure section which pressurizes the recording medium after an irradiation of the ultraviolet rays;

a controller which controls the first heating section to start heating the ultraviolet-ray curable ink on the recording medium after the last discharge of the ink to an arbitrary area on the recording medium; and a moving section which relatively moves the recording medium to the first heating section.

It is preferable that the moving section includes:

a pair of rollers which moves the recording medium to the first heating section, wherein one of the rollers is used as the heating section, and the other is used as the pressure section.

It is preferable that the moving section includes:

a roller and a belt which move the recording medium to the first heating section, wherein one of the roller and the belt is used as the heating section, and the other is used as the pressure section.

It is preferable that the image recording device, wherein the moving section includes:

a pair of belts which moves the recording medium to the first heating section, wherein one of the belts is used as the heating section, and the other is used as the pressure section.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

DETAILED DESCRIPTION OF THE PREFERRED EMBODIMENTS

Now, the embodiments for carrying out the present invention are explained in the following with referring to the appended drawings 1 to 23.

Figure 1:
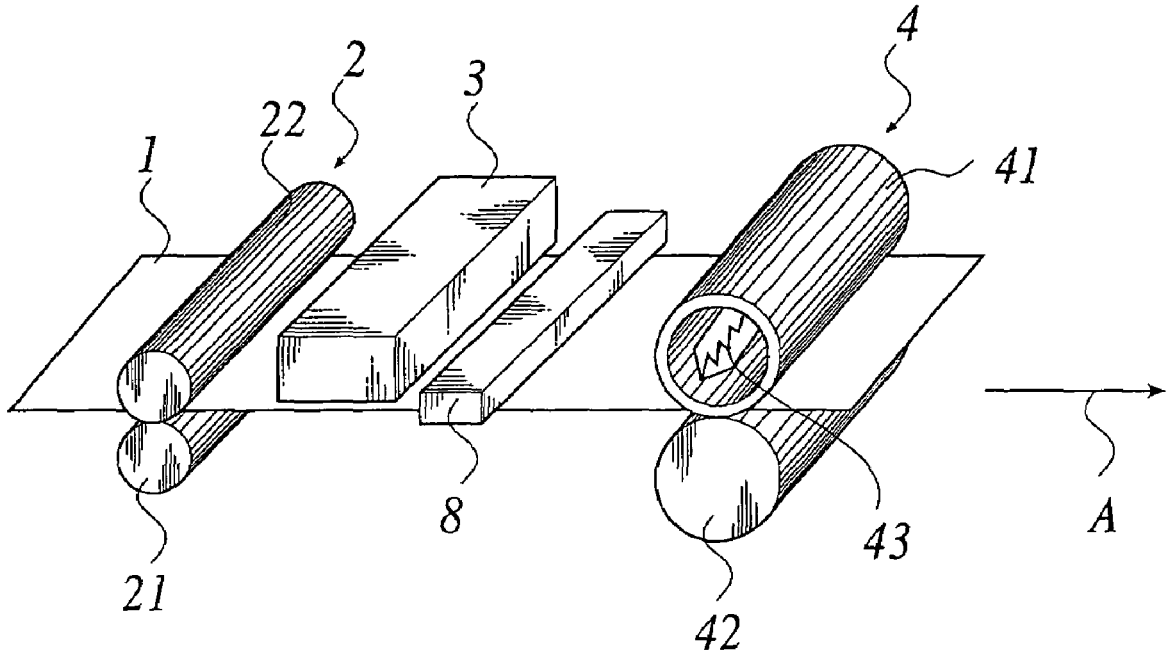
FIG. 1 is a view showing the major portion of a first embodiment for the present invention.

FIG. 1 illustrates the major portion of the first embodiment for the present invention. In this drawing, the ink jet recording device according to this embodiment comprises, toward the indicated right direction that is the moving direction A of a recording medium 1, a moving mechanism 2 adapted to move the recording medium 1 from the downstream side to the recording region of a recording head, a recording head 3 to which ink jet openings adapted to discharge ink onto the recording medium 1 are provided, a light source 8 adapted to irradiate light for curing the discharged ink by the recording head 3, and a heating/pressurizing section 4 adapted to heat and pressurize the recording medium 1.

The moving mechanism 2 has a moving roller 21 rotatively actuated by a driving section (not shown) and an inverse roller 22 for inserting the recording medium 1 under applying pressure between itself and the moving roller 21 and is adapted to move the recording medium 1 in a predetermined volume depending on rotative drive of the moving roller 21 in the state holding the recording medium 1 while applying pressure thereto between the moving roller 21 and the inverse roller 22 toward the moving direction A in accordance with the image recording performed by the recording head 3, that will be described later.

In this drawing, a roll paper in a long cylindrical shape scrolled like a roll is shown as an example of the recording medium 1. However, the recording medium 1 is not limited to this example, and any recoding medium in a sheet form cut into appropriate sizes, for example, any cut papers like coated paper and regular paper may be used.

The recording head 3 fixedly has ink jet openings having an array of nozzles that extend over the whole recording width of the recording medium 1 and forms a head of the line type that moves the recording medium 1 in the direction across the recording width and in the vertical direction to thereby form images. To the plurality of ink jet openings, a plurality of ink tanks each storing therein an ink with a color of Y (yellow), M (magenta), C (cyan), K (black) or the like are connected, respectively, and it is structured so as to eject given inks from the ink tanks through the ink jet openings at a given timing in accordance with an image data to be recorded.

In the embodiment, although the ink discharged from the recording head 3 is directly spotted on the recording medium 1, it is not limited thereto. The ink discharged from the recording head 3 may be transferred from a supporting body to the recording medium 1 after temporarily held by the supporting body such as a middle transferring body.

The ink used in this context is one that cures in response to light irradiation, preferably to ultraviolet ray irradiation, and containing water and organic solvents, as will be described later.

Besides, it is preferable that a recording medium holding unit (not shown) for holding the recording medium is provided on the opposite side of the recording head 3 via the recording medium 1, and the recording medium 1 is adsorbed onto the surface of the recording medium holding unit and a suction section (not shown) for preventing the recording medium 1 from being floated up is provided thereon.

The light source 8 is adapted to irradiate light that is for curing ink against the discharged ink on the recording medium 1 to thereby cure the ink. Preferred ultraviolet ray generating device usable for the above purpose include a light emitting diode (LED), a mercury lamp, a metal halide lamp, a chemical lamp, a black light lamp, a mercury-xenon lamp, an excimer lamp, a short-arc lamp, a helium-cadmium laser, an argon laser, an excimer laser and the like.

The heating/pressurizing section 4 is installed on the downstream side of the recording head 3 so as to heat/pressurize the recording medium 1 on which images have been already recorded/formed by the recording head 3 and is configured such that it has a heating roller 41 and a contact pressurizing roller 42 adapted to insert the recording medium 1 while applying pressure between itself and the heating roller 41.

Figure 2:
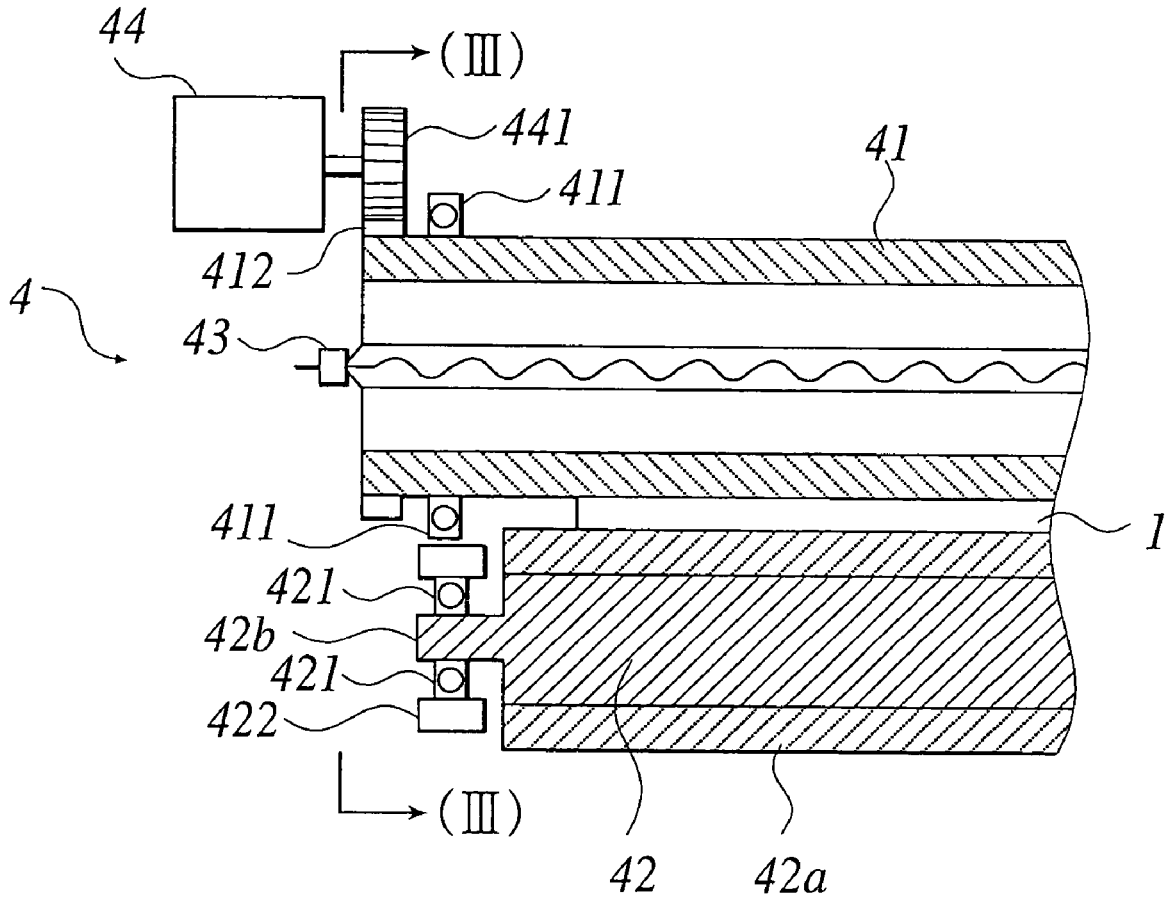
FIG. 2 is a sectional view showing the partial section of a heating/pressurizing section according to the first embodiment.
Figure 3:
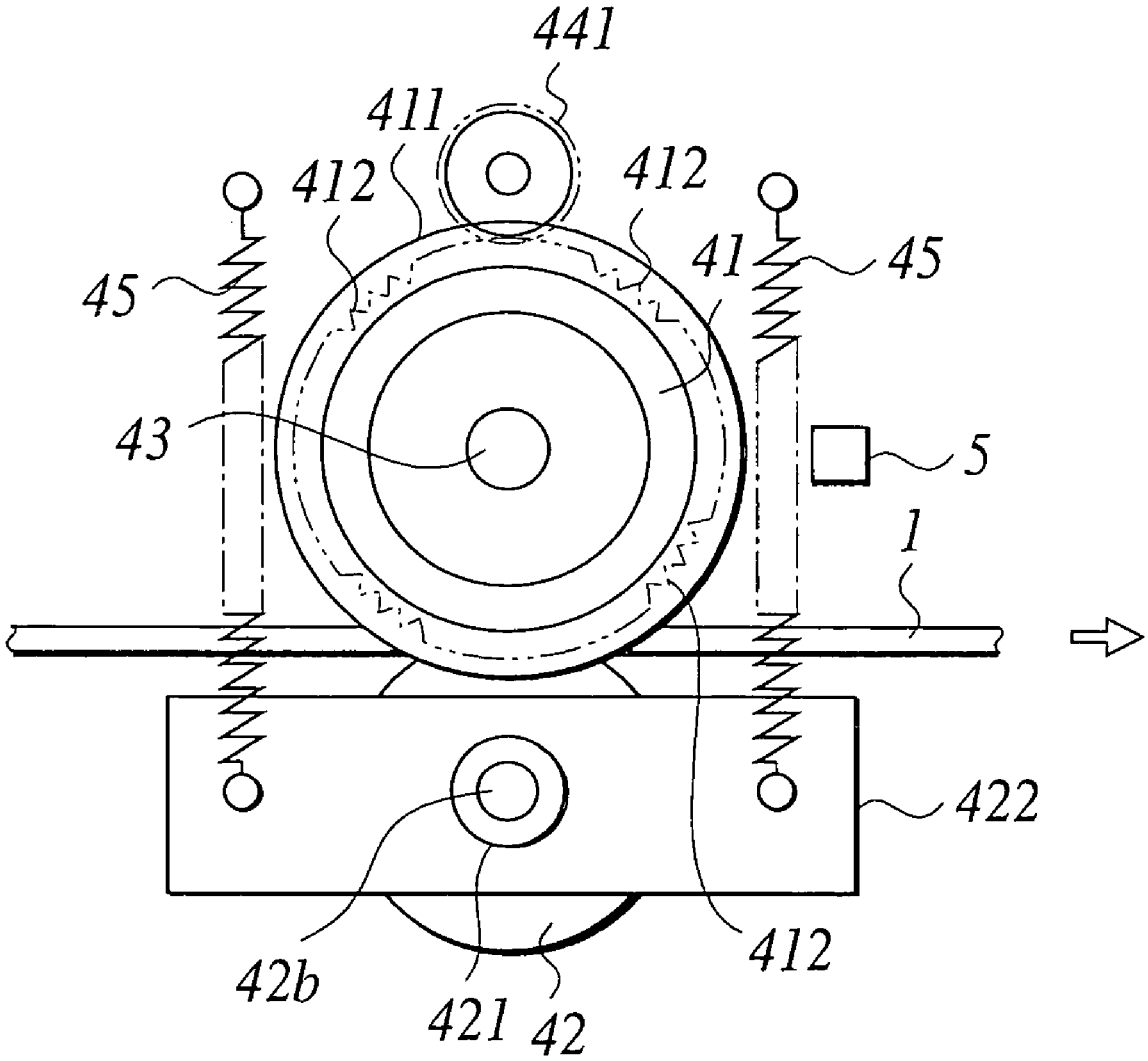
FIG. 3 is a sectional view of the heating/pressurizing section of FIG. 2 cut along a line (III)-(III)

As shown in FIGS. 2 and 3, the heating roller 41 is formed of a hollow roller supported by bearings 411 and includes an electrical heating element 43 such as a halogen lamp heater as a heat source in the axial direction. A gear 412 is formed around the periphery of the end of the heating roller 41, and the gear 412 is configured so as to engage with a gear 441 attached to the driving motor 44 for driving the heating roller 41. With such a configuration described above, the driving force of the driving motor 44 is transmitted to the gear 441 and the gear 412 so that the heating roller 41 is rotatively actuated toward a predetermined direction.

The heating roller 41 is preferably formed of a material having high thermal conductivity so that the heating roller 41 can heat efficiently the recording medium 1 with use of the heat generated from the electrical heating element 43, and it is preferable to use a metallic roller as the heating roller 41. In addition, on the surface of the heating roller 41, it is preferable that a fluorine resin coating is applied so that contaminations with the ink caused at the time of heating and pressurizing the recording medium 1 may be prevented from occurring. Alternatively, it is also possible to use a silicon rubber roller coated with a heat-resistant silicon rubber.

Besides, a temperature sensor 5 is installed in the vicinity of the surface of the heating roller 41. The temperature sensor 5 is configured to sense the temperature on the heating roller 41 to thereby control the heat release value from the electric heating element 43 by means of a temperature control section (not shown) and control to maintain the temperature of the heating roller 41 at a temperature in a given range.

On the other hand, the contact pressurizing roller 42 is formed of a metallic roller made from stainless steel or the like to which rubber coating 42*a* having elasticity at its outer circumference is applied. As shown in FIG. 3, roller shafts 42*b* at the both end portions of the contact pressurizing roller 42 are attached fixedly to a supporting frame 422 via the bearing 421, respectively. The supporting frame 422 is energized by energizing members 45, 45 so that the contact pressurizing roller 42 can pressurize the recording medium 1 against the heating roller 41, i.e., the contact pressurizing roller 42 can contact the heating roller 41 while applying a given pressure force thereto via the recording medium 1.

In the embodiment shown in the drawing, the contact pressurizing roller 42 is energized in a direction such that the contact pressurizing roller 42 is drawn toward the heating roller 41 side by the energizing members 45, 45. However, the contact pressurizing roller 42 may be installed such that it is energized in a direction that the contact pressurizing roller 42 is pushed with pressure toward the heating roller 41 side. Examples of the energizing members 45, 45 include a coil spring, a plate spring and the like. In addition to those springs, however, the energizing member may be arbitrarily selected from ones that can energize the contact pressurizing roller 42 with a given elastic force toward the heating roller 41 side.

The recording medium 1 on which a given image was formed by the recording head 3 is moved to the heating/pressurizing section 4 by means of the moving mechanism 2. In the heating/pressurizing section 4, the recording medium 1 is held between the heating roller 41 and the contact pressurizing roller 42 and is heated and pressurized while being moved at a fixed speed by the rotative drive of the heating roller 41.

In this embodiment, since the contact pressurizing roller 42 has the rubber coating 42*a* having elasticity on its surface (the contacting surface to the recording medium), a nip region, which is formed between the coating and the heating roller 41, is formed with having a certain width. At that time, by means of adjusting the vertical modulus of elasticity (Young's modulus) of the rubber coating 42*a*, which is the contact surface of the contact pressurizing roller 42 to the recording medium 1, to a range of $10^6$ to $10^7$ Pa, preferably $1.0\times10^6$ to $4.0\times10^6$ Pa, it may be feasible to render the heating roller 41 and the contact pressurizing roller 42 to contact in a large contacting area while applying pressure, whereby permitting to obtain appropriate pressure force and pressurizing period of time with a simple configuration.

Note that, with regard to the vertical modulus of elasticity, it is sufficient if it is configured such that the contacting surface of the recording medium 1 and at least one of the two rollers 41, 42 has a vertical modulus of elasticity (Young's modulus) in the above-defined range, or the vertical modulus of elasticity (Young's modulus) in the above-defined range may be realized by means of, for example, using a normal roller instead of the contact pressurizing roller 42 provided with the rubber coating 42*a* and applying a coating to the outer circumference of the heating roller 41 with heat-resistant silicon rubber or the like, or it may be configured such that both of the heating roller 41 and the contact pressurizing roller 42 come to have the vertical modulus of elasticity (Young' modulus) of the above-defined range.

Figure 4A:
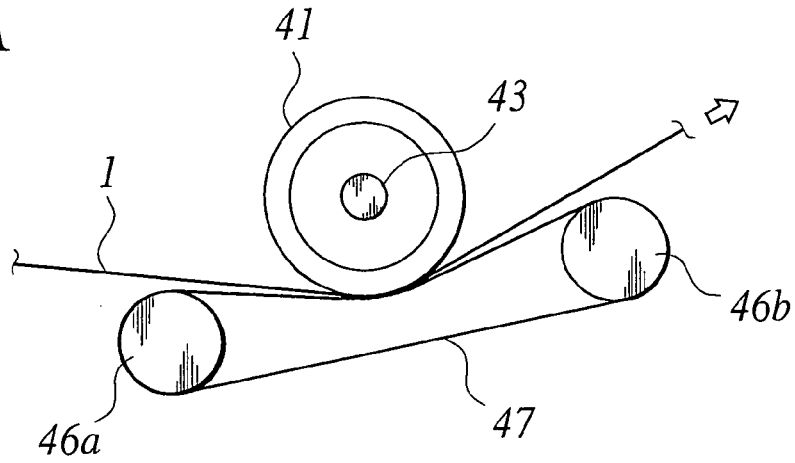
FIGS. 4A and 4B are a configurative view showing another configuration of the heating/pressurizing section according to the first embodiment.
Figure 4B:
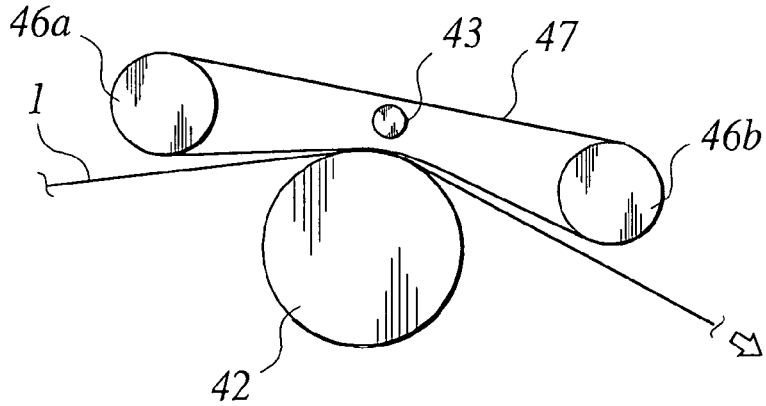
Figure 5:
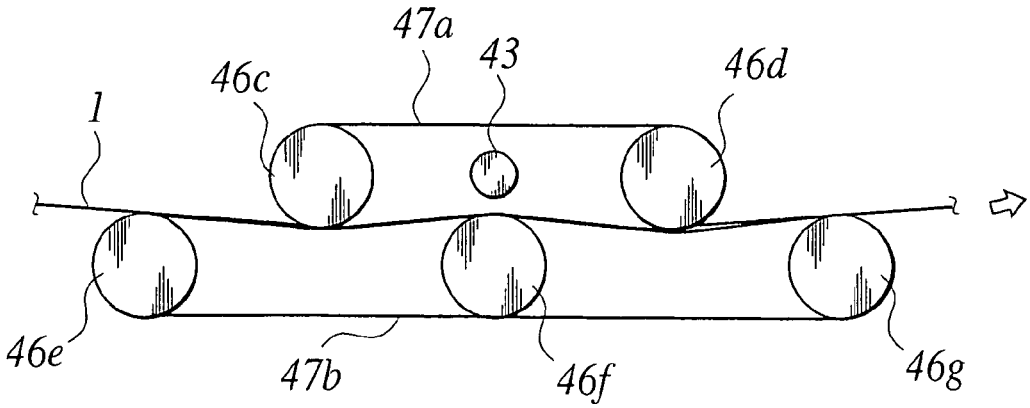
FIG. 5 is a configurative view showing still another configuration of the heating/pressurizing section according to the first embodiment.

In FIGS. 4 and 5, another embodiment for the heating/pressurizing section is illustrated.

Referring to FIG. 4A, the heating/pressurizing section 4, while it includes a heating roller 41 with a shape identical to those shown in FIGS. 1 to 3, is configured with the use of a belt member 47 suspended between two rollers 46*a*, 46*b* opposing to each other via the heating roller 41 and the recording medium 1 instead of the contact pressurizing roller 42 for pressurizing the recording medium 1 between itself and the heating roller 41.

In the above-defined configuration, because the belt member 47 is suspended with a given tension between the both rollers 46*a*, 46*b*, the belt member 47 may be pressurized in contact against the heating roller 41. With such a pressure, it is configured that the recording medium 1 is simultaneously held and pressurized between the belt member 47 and the heating roller 41 and is further moved in the right direction as indicated in the drawing by the rotative drive of the heating roller 41.

For the material for forming the belt member 47, a metal member made from, for example, stainless steel and an elastic member made from, for example, silicon rubber may be used.

With the configuration shown in FIG. 4A, it may be feasible to attain appropriate pressure force and pressurizing period of time even at the time of performing high-speed processing (printing) since the heating roller 41 and the belt member 47 are in surface contact. Besides, it is possible to adjust the arrangement of each roller 46*a*, 46*b* and the tension of the belt member 47 to thereby adjust the contacting area of the heating roller 41 and the belt member 47 and the pressure force easily.

Besides, in FIG. 4B, the heating/pressurizing section 4, while it includes a contact pressurizing roller 42 with a shape identical to those shown in FIGS. 1 to 3, is configured with the use of a belt member 47 being suspended between two rollers 46*a*, 46*b* those which are opposing to each other in between the contact pressurizing roller 42 and the recording medium 1, instead of the heating roller 41. Further, an electric heating element 43 is arranged inside the belt member 47 so that the belt member 47 is directly heated. Alternatively, for example, each of the rollers 46*a*, 46*b* for suspending the belt member 47 may be formed in a hollow shape and an electric heating element 43 may be installed in each of the rollers 46*a*, 46*b* to heat those rollers 46*a*, 46*b*, respectively.

With the configuration shown in FIG. 4B, like the embodiment shown in FIG. 4A, it may be feasible to attain appropriate pressure force and pressurizing period of time even at the time of performing high-speed processing (printing) since the contact pressurizing roller 42 and the belt member 47 are in surface contact. Furthermore, it may be feasible to adjust the arrangement of each of the rollers 46*a*, 46*b* and the tension of the belt member 47 to thereby control the contacting area of the contact pressurizing roller 42 and the belt member 47 and the pressure force easily.

Note that, in both configurations shown in FIGS. 4A and 4B, the number of the belt members 47 to be suspended is not limited to two, and three or more belt members may be used.

FIG. 5 shows an embodiment wherein the heating/pressurizing section 4 is configured with two belt members 47*a*, 47*b* opposing to each other via the recording medium 1 and groups of rollers (46*c* to 46*g*) for suspending the belt members 47*a*, 47*b*, respectively.

In FIG. 5, the belt member 47*a* is suspended such that it retains a given tension between two rollers 46*c* 46*d*, and an electric heating element 43 is installed inside thereof. The belt member 47*a* is configured to be heated by the electric heating element 43, and with such an arrangement, the belt member 47*a* operates as a belt member for heating.

On the other hand, the belt member 47*b* is arranged so as to oppose to the belt member 47*a* via the recording medium 1 and is suspended such that it retains a given tension over three rollers 46*e*, 46*f*, 46*g*. Note that the rollers 46*c*, 46*d* are positioned between the rollers 46*e* and 46*f*, and between the rollers 46*f* and 46*g*, respectively. With such a configuration, the belt member 47*b* operates as a belt member for pressurizing in contact.

In the embodiment shown in FIG. 5, the recording medium 1 is held with pressure between the belt members 47*a* and 47*b*, and the roller 46*c* or 46*d* is rotatively actuated by a driving section (not shown), while the belt member 47*a* for heating drives to the counterclockwise direction, so that the recording medium 1 is moved toward the right direction indicated in the drawing. It is configured such that the belt member 47*a* for heating and the belt member 47*b* for pressurizing in contact are opposed to each other in mutually pressurized state and are simultaneously heated and pressurized during the process of moving the recording medium 1 being held between the belt members 47*a* and 47*b* operated by the actuation of both of these belt members 47*a*, 47*b*.

Similarly, according to the embodiment shown in FIG. 5, it may be feasible to attain appropriate pressure force and pressurizing period of time particularly even at the time of high-speed processing since the belt members 47*a* and 47*b* are in surface contact to each other. Furthermore, it may be feasible to adjust the arrangement of each of the rollers 46*c* to 46*g* and the tensions of the belt members 47*a*, 47*b* to thereby control the contacting area of the both belt members 47*a* and 47*b* and the pressure force easily. Still further, by means of altering the arrangement of each of the rollers 46*c* to 46*g*, there is such an advantage that a degree of freedom in designing in conjunction with the moving direction of the recording medium 1 is more increased comparing to the embodiments shown in FIGS. 1 to 3, and 4. Accordingly, downsizing of the device and improvement in the operational handling may be facilitated.

Figure 6:
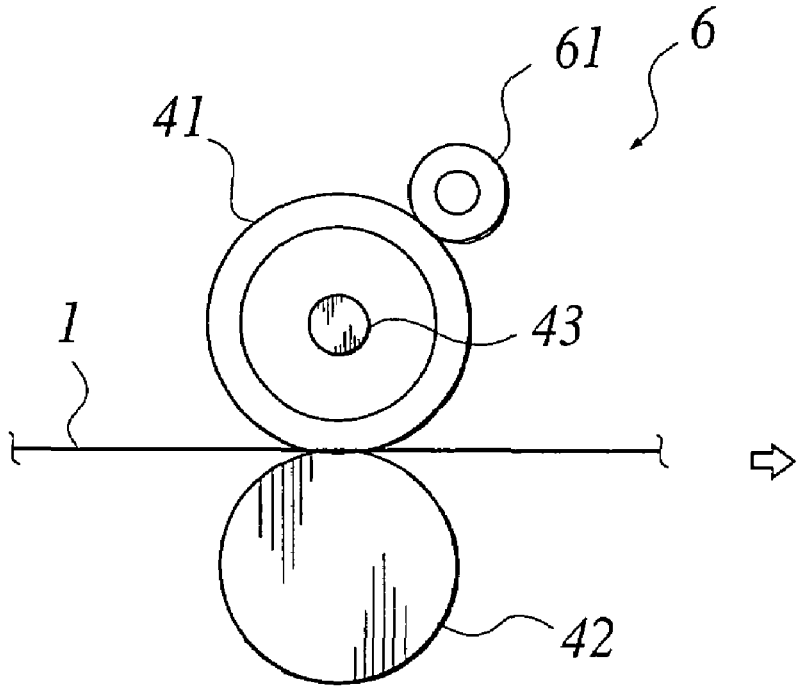
FIG. 6 is a configurative view showing a configuration of the heating/pressurizing section according to the first embodiment in which a cleaning section is attached to the heating/pressurizing section.
Figure 7:
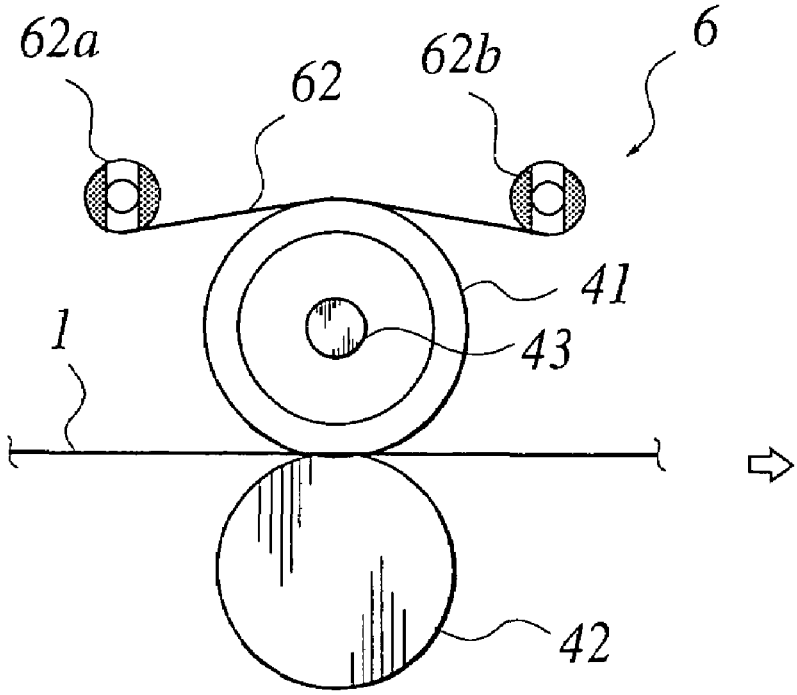
FIG. 7 is a configurative view showing another configuration of the heating/pressurizing section according to the first embodiment in which a cleaning section is attached to the heating/pressurizing section.

FIGS. 6 and 7 schematically show configurations of embodiments wherein a cleaning section 6 for cleaning contaminations attached to the contacting surface of the heating/pressurizing section 4 at the time of the heating and pressurizing processing of the recording medium is further installed.

FIG. 6 shows an embodiment wherein a cleaning roller 61 functioning as a cleaning section 6 is installed to the contacting surface to the recording medium on the outer circumference of the heating roller 41 in the heating/pressurizing section 4.

In FIG. 6, the cleaning roller 61 is formed of a sponge roller constructed by surrounding the outer circumference of a rotary shaft with sponge, extends in parallel to the heating roller 41 and is installed detachably. The cleaning roller 61 does not rotate normally, and the sponge surface thereof is in contact to the contacting surface to recording medium of the heating roller 41. The sponge surface is rendered to start rubbing off the contacting surface to recording medium by the rotative drive of the heating roller 41 to thereby wipe off contaminations thereon.

A rotary driving section (not shown) is provided to the cleaning roller 61. For example, when the number of the recording medium 1 treated exceeds a given volume, the roller 61 is controlled so that it is rotated at a predetermined angle (e.g., 5 degree) by the rotary driving section. Then, with using a new portion on the surface of the cleaning roller 61, the cleaning of the contacting surface to recording medium of the heating roller 41 is further carried out. When the whole surface of the cleaning roller was stained after rotating the roller 61 to a given extent, the roller 61 can be detached to replace either the sponge surface or the cleaning roller 61 itself.

FIG. 7 shows an embodiment wherein a cleaning belt 62 constituting the cleaning section 6 is provided to the recording medium contacting surface on the outer circumference of the heating roller 41 in the heating/pressurizing section 4.

As shown in FIG. 7, the cleaning belt 62 is configured such that it is formed of an nonwoven fabric or the like in a width substantially equal to at least the width of the recording medium contacting surface of the heating roller 41 and is engaged with two winding rollers 62*a*, 62*b* such that it links the two rollers across therebetween, where the cleaning belt may be run out from one of the winding rollers 62*a*, 62*b* and wound to the other roller 62*b* or 62*a* by means of the rotary driving section (not shown).

Further, the cleaning belt 62 is arranged so as to be in contact to the recording medium contacting surface of the heating roller 41 in the state that the belt 62 be engaged with the winding rollers 62*a*, 62*b* such that it links the rollers across therebetween. In the normal operation, the winding rollers 62*a*, 62*b* are not rotated, but the cleaning belt 62 starts to rub off contaminations on the recording medium contacting surface in response to the rotary actuation of the heating roller 41. For example, when the processed volume of the recording medium has reached to a given volume, the winding rollers 62*a*, 62*b* are controlled and actuated by the rotary driving section to rotate themselves at a given angle, whereby allowing the cleaning belt 62 to clean the recording medium contacting surface of the heating roller 41 with its new surface. When the whole cleaning belt 62 has wound up, it is structured to be detached and replaced with the new one.

By means of providing the cleaning section 6 for cleaning the heating/pressurizing section 4 as shown in the embodiments of FIGS. 6 and 7, it may be feasible to prevent the images on the recording medium 1 from being stained at the time of the heating/pressurizing processing, which is caused by the stains on the contacting surface of the heating/pressurizing section 4 to the recording medium 1, and the heating and pressurizing performance from being decreased to thereby retain the ink receptible layer of the recording medium 1 transparent all the time in good condition.

Figure 8:
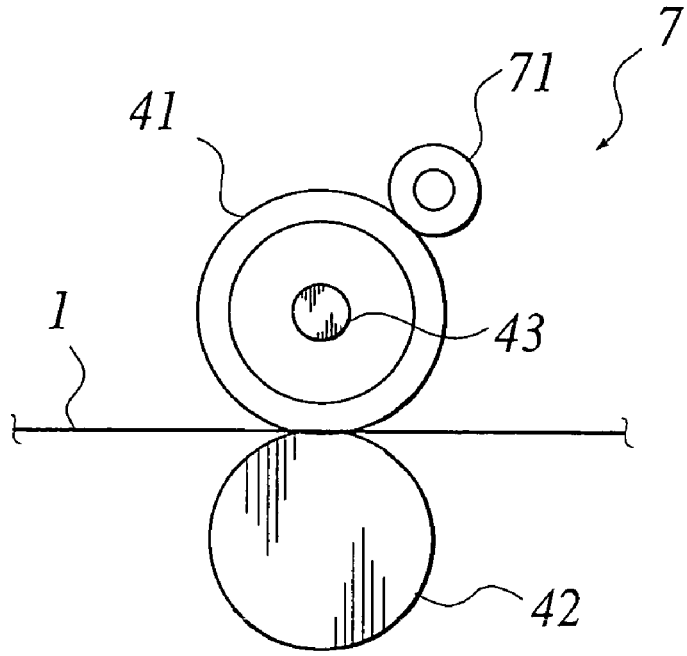
FIG. 8 is a configurative view showing a configuration of the heating/pressurizing section according to the first embodiment in which a transfer-preventing solution applying section is attached to the heating/pressurizing section.
Figure 9:
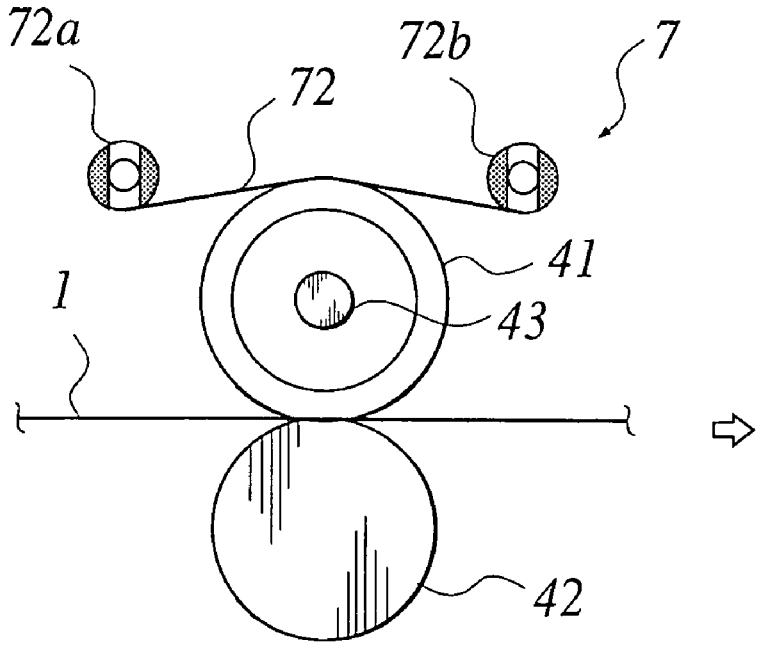
FIG. 9 is a configurative view showing another configuration of the heating/pressurizing section according to the first embodiment in which a transfer-preventing solution applying section is attached to the heating/pressurizing section.
Figure 10:
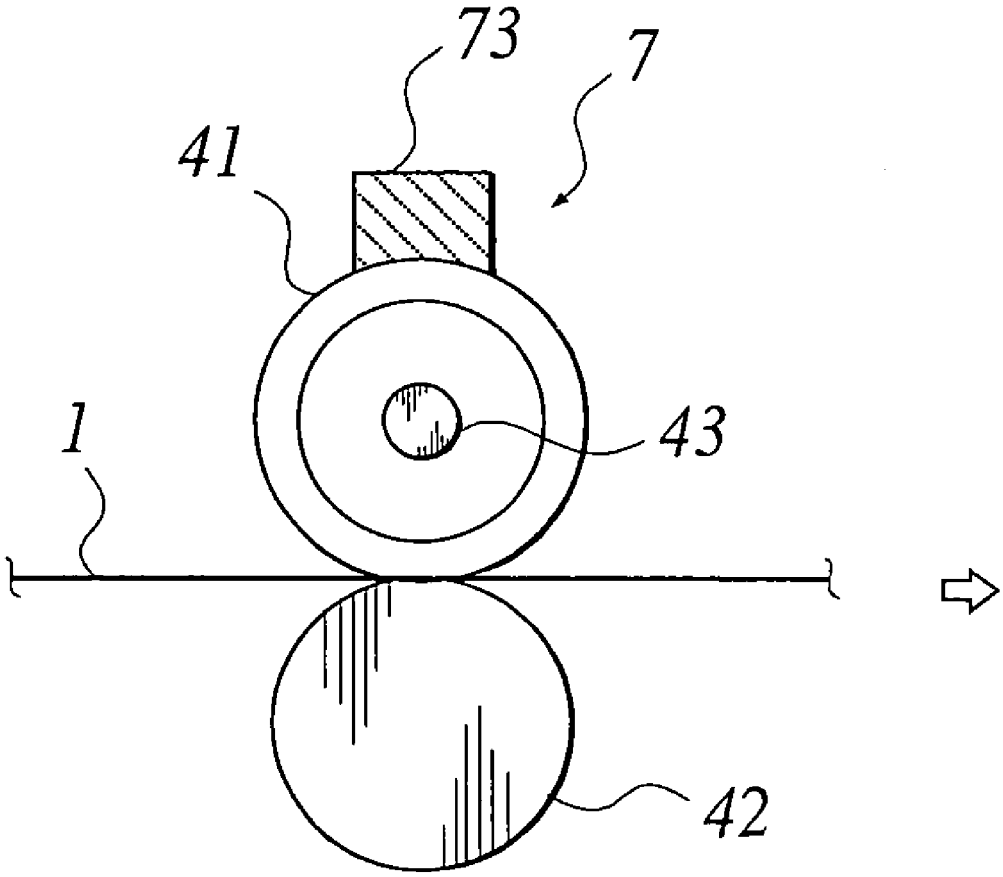
FIG. 10 is a configurative view showing another configuration of the transfer-preventing solution applying section.

FIGS. 8 to 10 show the schematic configurations of embodiments wherein a transfer-preventing solution applying section 7 for preventing the attachment of stains to the recording medium contacting surface of the heating/pressurizing section 4 at the time the recording medium is heated and pressurized is further provided, respectively.

The transfer-preventing solution applying section 7 is structured to apply a transfer-preventing solution, that is for preventing the ink applied to the surface of the recording medium 1 from either a part of the recording medium 1 or the recording head 3 from being transferred to the recording medium contacting surface of the heating/pressurizing section 4, onto the recording medium contacting surface. The transfer-preventing solution preferably contains silicon oil. Silicon oil is a cheap material but is stable, and it can surely prevent the recording medium contacting surface from being stained.

In FIG. 8, an embodiment, wherein the transfer-preventing solution applying section 7 comprises a spreader roller 71 being provided with a sponge roller that has impregnated a transfer-preventing solution and is arranged so as to be in contact to the outer circumference of the heating roller 41, that is the recording medium contacting surface, is shown.

As shown in FIG. 8, it is configured such that a transfer-preventing solution impregnated in the spreader roller 71 is applied onto the recording medium contacting surface by the rotary drive of the heating roller 41. In addition, it is also configured such that a rotary driving section (not shown) is mounted to the spreader roller 71 so that the spreader roller 71 may be actuated to rotate at a given angle to apply the transfer-preventing solution by using the new surface thereof at every occasion where the number of sheets of the applied recording medium runs into a given volume. Since the spreader roller 71 is detachably mounted, it may be replaced with the new one when the impregnated transfer-preventing solution was run out.

Besides, in FIG. 9, an embodiment wherein a spreader belt 72 formed of a nonwoven fabric or the like in which a transfer-preventing solution is impregnated is provided such that it is spanned between the two winding rollers 72*a*, 72*b* and the spreader belt 72 is configured such that it contacts the recording medium contacting surface of the heating roller 41 is shown.

In the embodiment shown in FIG. 9, it is configured such that a transfer-preventing solution impregnated in the spreader roller 72 is applied onto the recording medium contacting surface in response to the rotary drive of the heating roller 41. Furthermore, a rotary driving section (not shown) is mounted to the winding roller 72*a* or 72*b* so that the rotary driving section actuates the winding roller 72*a* or 72*b* to rotate at a given angle at every occasion where the number of sheets of the recording medium runs into a given volume to thereby wind away the portion having been used for applying the transfer-preventing solution and to render the new portion of the spreader belt 72 to apply the transfer-preventing solution. Since the spreader belt 72 is detachably mounted, it may be replaced with the new one.

In FIG. 10, an embodiment wherein a spreader pad 73 formed of a nonwoven fabric or the like in which a transfer-preventing solution is impregnated is provided and the spreader pad 73 is configured such that it contacts the recording medium contacting surface of the heating roller 41 is shown.

In FIG. 10, it is configured such that a transfer-preventing solution impregnated in the spreader pad 73 is applied onto the recording medium contacting surface in response to the rotary drive of the heating roller 41. Note that, in this configuration, since the spreader pad 73 is detachably provided, it may be replaced with the new one when the impregnated transfer-preventing solution was run out.

By means of providing the transfer-preventing solution applying section 7 for applying a transfer-preventing solution onto the recording medium contacting surface of the heating/pressurizing section 4 as shown in FIGS. 8 to 10, it may be feasible to prevent the part of the recording medium 1 or the ink from being transferred to the recording medium contacting surface of the heating/pressurizing section 4, and accordingly, to prevent the images on the recording medium from being stained and the heating and pressurizing performance from being depressed.

Figure 11:
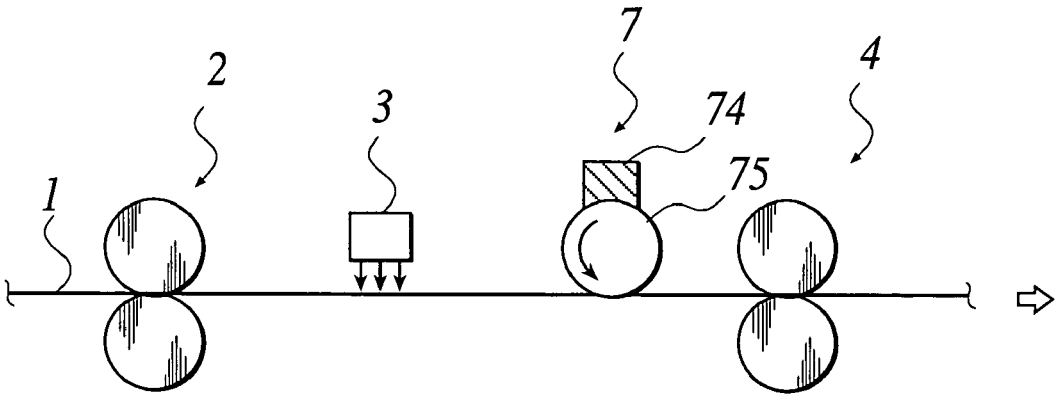
FIG. 11 is a configurative view showing still another configuration of the transfer-preventing solution applying section.

FIG. 11 shows a still other embodiment for the transfer-preventing solution applying section 7.

The transfer-preventing solution applying section 7 shown in FIG. 11 is disposed not to the side of the recording medium contacting surface of the heating/pressurizing section 4 but at a position that is in the downstream side of the recording head 3 and moreover in the upstream side of the heating/pressurizing section 4, and is adapted to apply a transfer-preventing solution onto the recording medium 1 at the stage following to the image recording performed by the recording head 3 and prior to the heating and pressurizing processing carried out by the heating/pressurizing section 4.

In this embodiment, the transfer-preventing solution applying section 7 comprises a spreader pad 74 impregnating a transfer-preventing solution, which is similar to the one in the embodiment shown in FIG. 10, and a spreader roller 75 arranged so as to contact the recording side of the recording medium 1 on which images have been already recorded and formed by the recording head 3. The transfer-preventing solution impregnated in the spreader pad 74 is applied onto the recording side of the recording medium 1 along with the rotary movement of the spreader roller 75.

Similar to the embodiment previously described, by means of applying a transfer-preventing solution by the transfer-preventing solution applying section 7 to the recording medium 1 at the stage following to the image recording performed by the recording head and moreover prior to the heating and pressurizing processing carried out by the heating/pressurizing section 4 as shown in FIG. 11, it may be feasible to prevent the part of the recording medium 1 or the ink from being transferred to the recording medium contacting surface of the heating/pressurizing section 4, and accordingly, to prevent the images on the recording medium from being stained and the heating and pressurizing performance from being depressed.

Note that, although it has been explained in FIG. 11 for the case that the transfer-preventing solution is impregnated in the spreader pad 74, the transfer-preventing solution may be impregnated in either the spreader roller 71 comprising the sponge roller shown in FIG. 8 or the spreader belt 72 shown in FIG. 9, and the recording medium 1 may be applied with the transfer-preventing solution in either manner of causing the spreader roller 71 or the spreader belt 72 to contact the spreader roller 75 as shown in FIG. 11 and apply the transfer-preventing solution along with the rotary movement of the spreader roller 75 or causing the spreader roller 71 or the spreader belt 72 to contact the recording medium 1 directly and apply the solution without using the spreader roller 75.

Besides, in connection with the heating and pressurizing carried out by the heating/pressurizing section 4, it is preferable to further provide a control section (not shown) for controlling at least one of the heating condition and pressurizing condition in accordance with at least one of the recording condition performed by the recording head 3 and the type of the recording medium.

Examples of the recording condition include, for example, the type of an ink to be used for the recording head 3, periods of time required for discharging various types of inks, and the discharging amounts of various types of inks. The condition as to the type of the recording medium includes, for example, the material, the thickness, and the state of the surface (e.g., presence of reticulation, brightness, etc.).

Further, the heating condition to be controlled includes a timing to start heating, a heating temperature, a heating period of time exposed to the ink, and so on.

Heating may be carried out before, after, or when the ink is discharged, and preferably after the ink is discharged and 1 to 120 seconds passes. Further, the period until heating is started indicates a period from the final discharging of the ink to an arbitrary area on the recording medium in case the same recording area is discharged with the ink several times because of interleaving till starting heat. That is, the period means a period from the final discharging of the ink to the arbitrary area on the recording medium until the ink held in the area is started being heated. If the period to start heating is too long, it may undermine the printing productivity and cause flix.

Further, the temperature of the recording medium at the time it is transferred to the bottom of the recording head is not more than the boiling point of the main volatile solution. If the temperature of the recording medium at this time is not less than the boiling point of the main volatile solution, the accuracy for recording is undermined.

Control of the heating temperature is feasible by adjusting the calorific value of the heat source 43, and when the temperature range retained by the heat source 43 is given as $(T0 \pm \Delta T)$° C., it is preferable that T0 falls within a range of 50° C. to 200° C. and $\Delta T$ falls within a range lower than 10° C. If the temperature is too low, sufficient curing of the ink cannot be obtained, and if the temperature is too high, recorded images with good quality cannot be obtained because the recording medium may cause significant shrinkage depending on the type.

Control of the heating period of time is feasible, for example, by adjusting the number of revolutions of the roller that determines the period of time during which the recording medium is inserted between the heating roller 41 and the other roller, and it is preferable that the heating period of time is controlled in a range of 0.1 to 10 seconds.

A heat quantity is equal to the maximum calorific value necessary for dehydrating ink and can be calculated by the following terms.

In case an aqueous ink is used, if the percentage of water content is 70% with respect to 10 $g/m^2$ of the discharged ink, the volume of water which is included in the ink and which is about to be dried is 7$g/m^2$. Meanwhile, because the latent heat of evaporation, the initial temperature of ink, and the heat quantity necessary for heating the ink up to 100° C. are respectively 2.254 KJ/g, 20° C., and 0.335 KJ/g, the maximum calorific value necessary for drying the ink is $$(2.254\ \text{KJ/g}+0.335\ \text{KJ/g})\times 7\ \text{g/m}^2=18.12\ \text{KJ/m}^2.$$

In the present invention, the heat quantity exposed to the ink which was discharged from the recording head 3 and which is on the recording medium is defined as follows.

(Heat quantity exposed to the ink)=(Heating temperature)×(Heating period of time exposed to the ink)

Therefore, control of the heat quantity exposed to the ink is achieved by controlling the heating temperature and/or controlling the heating period of time exposed to the ink.

With respect to the control of the heating period of time exposed to the ink, the embodiment exemplifies that the recording medium is moved by the heating roller 41 and the contact pressurizing roller 42. The heating period of time exposed to the ink can be controlled by changing the moving speed thereof.

Control of the heating period of time exposed to the ink is not limited thereto, and can be achieved by elongating the moving route of the heating step as well as changing the moving speed.

Anyway, it can be controlled by providing the section for relatively moving the heating section and the recording medium, and by changing the relative moving period of time.

Further, as described above, in the heating section, control of the heating period of time exposed to the ink can be controlled by stopping the recording medium on the heating section and changing the stopping period of time, as well as by the embodiment in which the recording medium is heated while moved.

Further, in the embodiment, although the heating section and the pressure section are convertible as the heating/pressurizing section 4 and the heating and pressurizing steps are completely overlapped, the heating section and the pressure section may not convertible. Further, the embodiment in which the heating and pressurizing steps are not completely overlapped exists, and thereby, it is important that at least a part of the heating and pressurizing steps is overlapped to the extent that the effect of the present invention can be obtained.

Besides, examples of the pressurizing condition to be controlled include the timing to start pressurizing, the pressure force, and pressurizing period of time.

Pressurizing may be carried out preferably after the ink is discharged and 0.1 to 120 seconds passes. Further, the period until pressurizing is started indicates an period from the final discharging of the ink to an arbitrary area in case the same recording area is discharged with the ink several times because of interleaving till starting pressurize. That is, the period means a period from the final discharging of the ink to the arbitrary area on the recording medium until the ink held in the area starts being pressurized. If the period to start pressurizing is too long, it may undermine the printing productivity and cause flix.

Control of the pressure force is feasible, for example, by adjusting a bias member 45 for pressing the contact pressurizing roller 42 toward the heating roller 41 side or by adjusting the tension of the belt member 47. It is preferable that the pressure force is adjusted in a range of $9.8\times10^3$ Pa to $4.9\times10^6$ Pa, preferably $9.8\times10^4$ Pa to $4.9\times10^6$ Pa. Note that the pressure force can be determined by converting from the degree of color development on a thermosensible paper following to inserting the thermosensible paper to pressurize it by the heating/pressurizing section 4. If the pressure force is insufficient, it is hard to attain sufficient curing of the ink, while if the pressure force is too much, the ink may be destroyed too much to alter its density depending on the quantity of the ink.

Control of the pressurizing period of time is feasible, for example, by adjusting the number of revolutions of the roller that determines the period of time during which the recording medium is inserted between the heating roller 41 and the other roller, and it is preferable that the pressurizing period of time is controlled in a range of 0.1 to 10 seconds.

The controls of the heating condition and the pressurizing condition in the manner as described above make possible to carry out the discharging of ink and the heating and pressurizing processing of the recording medium following to the light irradiation processing under the optimal condition for curing and dehydrating in a short period of time the ink all the time. Further, the light is irradiated preferably before the heating processing and/or pressurizing processing is carried out. Further, the timing from the light irradiation until the pressurizing processing is carried out is preferably 0.1 to 10 seconds.

Now, the operations of the embodiments for the present invention will be explained below.

Figure 12:
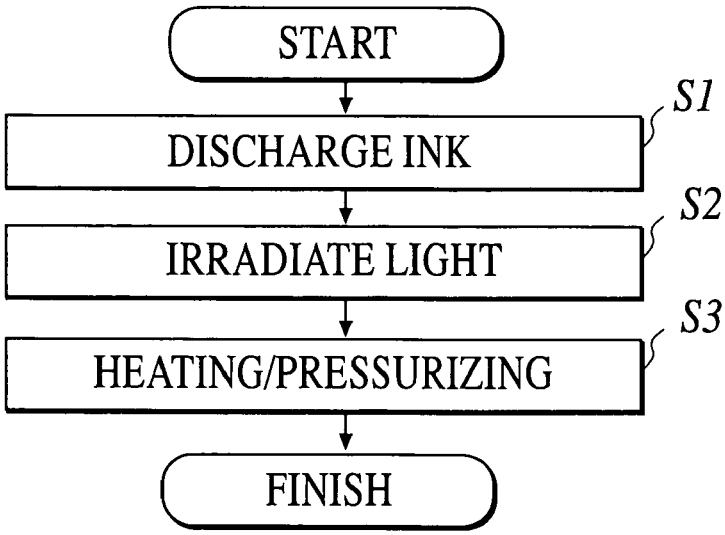
FIG. 12 is a flow chart explaining the operation of the first embodiment.

FIG. 12 is a flow chart explaining the operation of the ink jet recording device according to the first embodiment for the present invention. In the ink jet recording device shown in FIG. 1, a recording medium 1 is supplied by a supply section (not shown) and is then moved by a moving mechanism 2 to a recording head 3 located at the downstream side in the moving direction A, and an ink is discharged from the recording head 3 onto the recording medium 1 (Step S1). Following thereto, the recording medium 1 is moved by the moving operation of the moving mechanism 2 into the light irradiation region of a light source 8 and is exposed to the light there. The ink discharged onto the recording medium 1 starts the curing reaction in response to the light irradiation (Step S2).

The recording medium 1 in which the ink has cured on the recording side is moved into the heating/pressurizing section 4 and is heated and pressurized therein (Step S3). Note that the heating and pressurizing processing are preferably carried out under an optimal condition depending upon the situation in accordance with the condition for the recording performed by the recording head 3 and the type of the recording medium.

The ink in the images recorded and formed on the recording medium as described above has become a state having been cured and dehydrated in a short period of time.

As described above, since the time length required from the adhesion of the discharged ink until the dehydration of the ink is greatly shortened, it may be feasible to realize high printing productivity even employing an ink jet printer using an active energy ray curable ink containing a solvent, particularly water. Furthermore, since pressurizing processing is carried out during the dehydration of the ink, holds on the recording medium that may be caused during the high-speed printing operation and troubles during the moving, which are used to be problematic in the conventional technology, are prevented from occurring.

Figure 13:
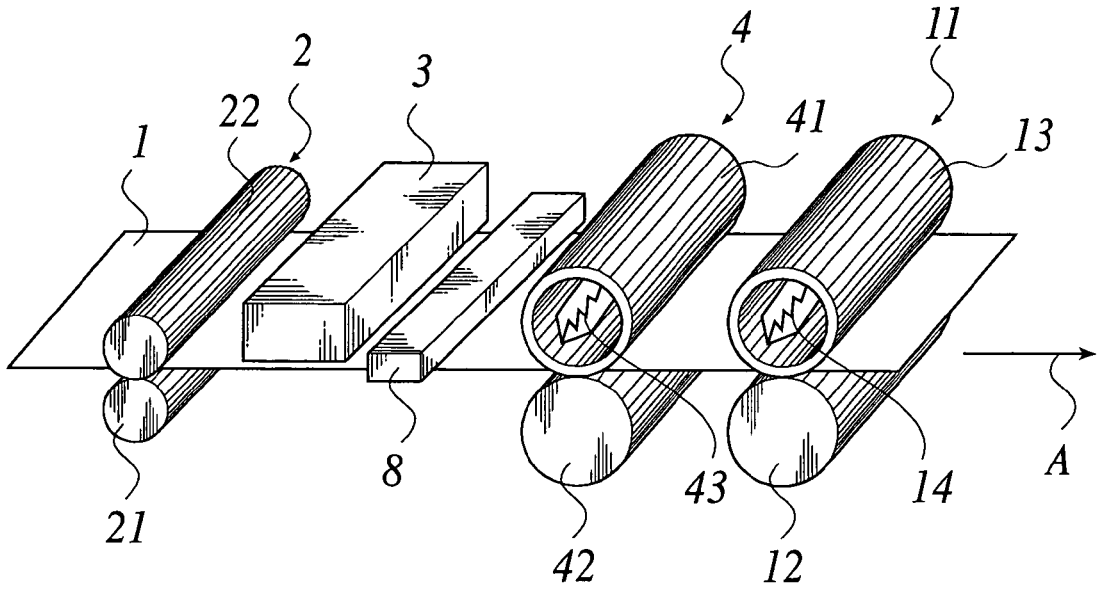
FIG. 13 is a view showing the major portion of a second embodiment for the present invention.

FIG. 13 shows the major portion of the ink jet recording device according to the second embodiment. The ink jet recording device is provided with a moving mechanism 2 for moving the recording medium 1 from the downstream side to the recording region of a recording head 3 toward the direction A of moving the recording medium 1, that is the right direction in the drawing, a recording head 3 provided with ink jet openings for discharging an ink onto the recording medium 1, a light source 8 for irradiating light for curing the ink discharged by the recording head 3, a heating/pressurizing section 4 for heating and pressurizing the recording medium, and a finishing heating section 11 for performing finishing heat processing of the recoding medium having been previously heated and pressurized.

The recording medium 1, the moving mechanism 2, the recording head 3, the light source 8 and the heating/pressurizing section 4 constituting the ink jet recording device according to the second embodiment are as explained above for the first embodiment.

Same as the moving mechanism 2, for example, the finishing heating section 11 is configured by including a moving roller 12 rotatively driven by a driving section (not shown) and a follower roller 13 for holding by insertion the recording medium 1 between itself and the moving roller 12 so that the finishing heating section 11 feeds out the recording medium 1 in the moving direction A while maintaining the state of holding by insertion the recording medium 1 between the moving roller 12 and the follower roller 13 by the rotative driving of the moving roller 12. Besides, the follower roller 13 is formed in a hollow shape, and a heat source 14 similar to the above-described heat source 43 is installed therein.

The finishing heating section 11 may be constituted with a pair of rollers as shown in FIG. 13, or may be constituted with a heating roller and a contact pressurizing roller like the heating/pressurizing section 4, or may be constituted by using a belt member as shown in FIGS. 4 and 5 that was described as the heating/pressurizing section 4.

Besides, the heat source 14 is not limited to be installed in the follower roller 13 and may be installed in the moving roller 12.

Now, the operation of this embodiment will be explained in the following.

Figure 14:
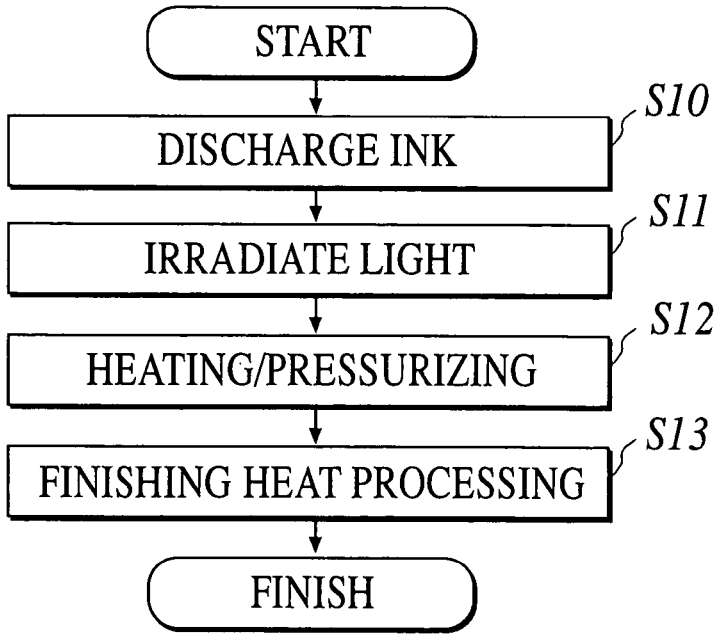
FIG. 14 is a flow chart explaining the operation of the second embodiment.

FIG. 14 is a flow chart explaining the operation of the ink jet recording device according to the second embodiment. In the ink jet recording device shown in FIG. 13, the recording medium 1 is supplied by a supply section (not shown) and is moved by the moving mechanism 2 in the moving direction A to the recording head 3 located at the downstream side, and the ink is discharged from the recording head 3 onto the recording medium 1 (Step S10). Subsequent thereto, the recording medium 1 is moved to the light irradiation region of the light source 8 owing to the moving operation of the moving mechanism 2 and exposed to light so that the ink is rendered to start the curing reaction of itself (Step S11).

The recording medium 1 in which the ink has cured on the recording side is moved to the heating/pressurizing section 4 and then subjected to heating and pressurizing processing (Step S12). Note that the heating and pressurizing processing are preferably applied under an optimal condition depending on the situation in accordance with the condition for recording performed by the recording head 3 and the type of the recording medium.

Then, the recording medium 1 having been heated and pressurized is moved to the finishing heating section 11 and applied there with finishing heat processing in order to completely dehydrate the ink.

The condition for the finishing heat processing at this time may be controlled by adjusting the volume of the ink to be discharged, the type and the thickness of the recording medium, etc. The heating may be carried out by employing a method of non-contact manner with the use of warm air, microwave, infrared radiation or the like, or by a method of contact manner with the use of a heating roller or a heating belt. It is preferable that the two third of the volatile components have been eliminated from the ink before applying the finishing heat processing.

Since the time length required from the ink discharging until the dehydration of the discharged ink is finished is greatly shortened as described above, it may be feasible to realize high printing productivity even employing an ink jet printer that uses an active energy ray curable ink containing a solvent system, particularly water. Furthermore, the pressurizing processing is applied during the curing and dehydration of the ink in a short period of time, it becomes needless to fear occurrence of holds on the recording medium that may be caused during high-speed printings and troubles during the moving, which are problematic in the earlier development.

In addition, since the finishing heat processing is carried out (Step S13), even though the curing and dehydration of the discharged ink in a short period of time onto the recording medium 1 was failed due to the heating processing (Step S12), it may be feasible to cure and dehydrate the ink in a short period of time.

Figure 15:
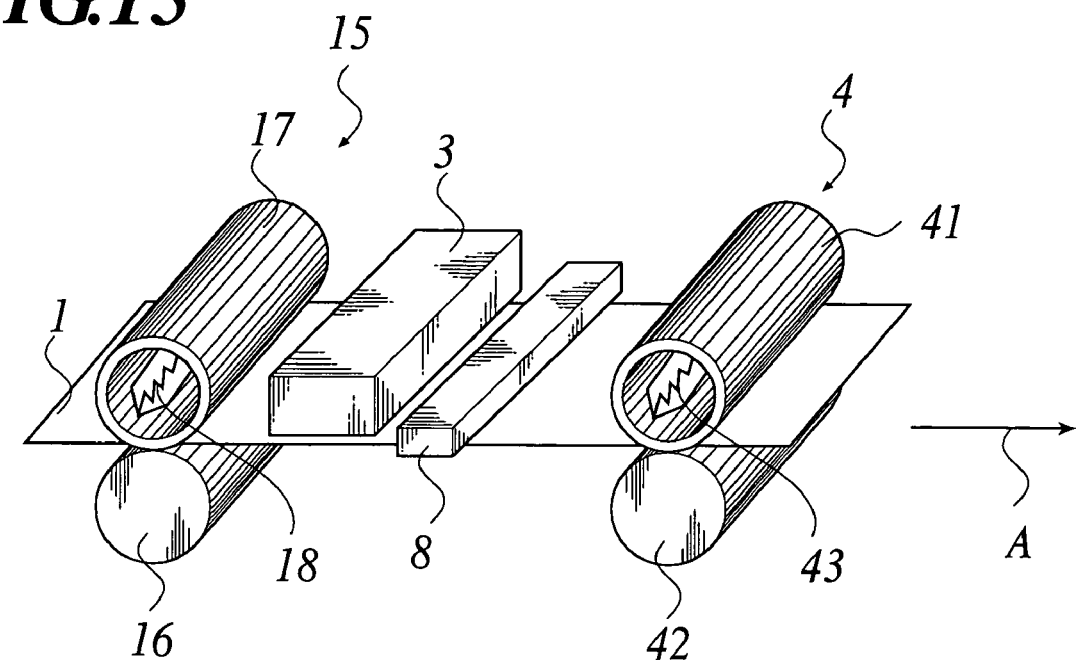
FIG. 15 is a view showing the major portion of a third embodiment for the present invention.

FIG. 15 shows the major portion of the ink jet recording device according to the third embodiment of the present invention. The ink jet recording device of this embodiment is provided with a preliminary heating section 15 for moving the recording medium 1 in the moving direction A of the recording medium 1, that is the right direction in the drawing, from the downstream side to the recording region of a recording head 3 and preliminarily heating the recording medium 1 before starting printings, a recording head 3 provided with ink jet openings for discharging the ink onto the recording medium 1, a light source 8 for irradiating light for curing the ink discharged from the recording head 3, and a heating/compressing section 4 for heating and pressurizing the recording medium.

The recording medium 1, the recording head 3, the light source 8 and the heating/compressing section 4 constituting the ink jet recording device according to this embodiment are as explained above for the first embodiment.

The preliminary heating section 15 that acts as the moving mechanism as well is constituted by including a moving roller 16 rotatively driven by a driving section (not shown) and a follower roller 17 for inserting the recording medium 1 between itself and the moving roller 16, and is configured to move the recording medium 1 in a given volume while maintaining the state that the recording medium 1 has been held by insertion between the moving roller 16 and the follower roller 17 in the moving direction A corresponding to the images recorded by the recording head 3 by the rotative drive of the moving roller 16. Besides, the follower roller 17 is formed in a hollow shape and is provided therein with a heat source 18 that is similar to the above-described heat source 43.

The heat source 18 is not limited to be installed in the follower roller 17, and it may also be installed inside the moving roller 16. Further, the moving mechanism and the preliminary heating section are not always required to be configured in one unit, and they may be constituted by the separate members.

Now, the operation of this embodiment will be explained in the following.

Figure 16:
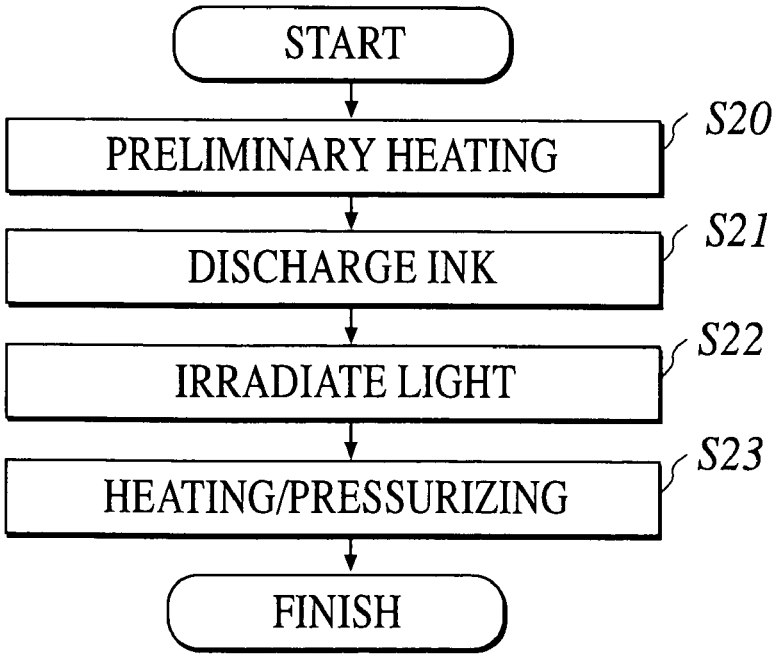
FIG. 16 is a flow chart explaining the operation of the third embodiment.

FIG. 16 is a flow chart explaining the operation of the ink jet recording device according to the third embodiment. In the ink jet recording device shown in FIG. 15, the recording medium 1 is supplied by a supply section (not shown) and preliminarily heated by the preliminary heating section 15 (Step S20).

Conditions for the preliminary heating processing may be controlled by adjusting the amount of the discharged ink, and the type and thickness of the recording medium, and the like. The heating may be carried out by employing a method of non-contact manner with the use of warm air, microwave, infrared radiation or the like, or by a method of contact manner with the use of a heating roller or a heating belt. It is preferable that 0 to 80% of the volatile components have been eliminated by the preliminary heating prior to proceeding to the subsequent heating and pressurizing. In case the volatile components exceeding 80% were eliminated, the advantageous effect of the present invention will be diminished.

The recording medium preliminarily heated is moved to the recording head 3 locating at the downstream side in the moving direction A by means of the moving operation of the preliminary heating section 15 functioning as the moving mechanism, where the ink is discharged onto the recording medium 1 from the recording head 3 (Step S21). Following thereto, the recording medium 1 is moved to the light irradiation region of the light source 8 by means of the moving operation of the preliminary heating section 15 functioning as the moving mechanism, the light irradiation is carried out there to cause the curing reaction of the ink to start (Step S22).

The recording medium 1 in which the ink has been cured on the recording side is moved to the heating/compressing section 4 and is subjected to the heating and pressurizing processing there (Step S23). Note that it is preferable to control the heating and pressurizing processing so that those processing may be carried out under the optimal condition depending on the situation in accordance with the condition for recording performed by the recording head 3, the type of the recording medium and the like.

Thus, the ink in the images recorded and formed on the recording medium as described above has become a state having been cured and dehydrated in a short period of time.

As described above, since the time length required from the adhesion of the discharged ink until the dehydration of the ink is finished is greatly shortened, it may be feasible to realize high printing productivity even employing an ink jet printer using an active energy ray curable ink containing a solvent, particularly water. Furthermore, since pressurizing processing is carried out during the curing and dehydration of the ink in a short period of time, holds on the recording medium that may be caused during the high-speed printing operation and troubles during the moving, which are used to be problematic in the earlier development, are prevented from occurring.

Furthermore, the efficiency of the heating processing (Step S23) may be improved even though the recording medium is a relatively large material in the dimension and has a large heat capacity, by means of carrying out the preliminary heating processing of the recording medium 1 (Step S20). As a result, the dehydration of the ink may be attained in a short period of time and it may be feasible to realize high-speed printings even though employing a recording medium in a large size and with an inferior thermal efficiency.

Although the case that only either one of the finishing heat processing or the preliminary heating processing is carried out was explained in the second and third embodiments, more improved high-speed printings may be performed by means of carrying out both the finishing heat processing and the preliminary heating processing.

Figure 17:
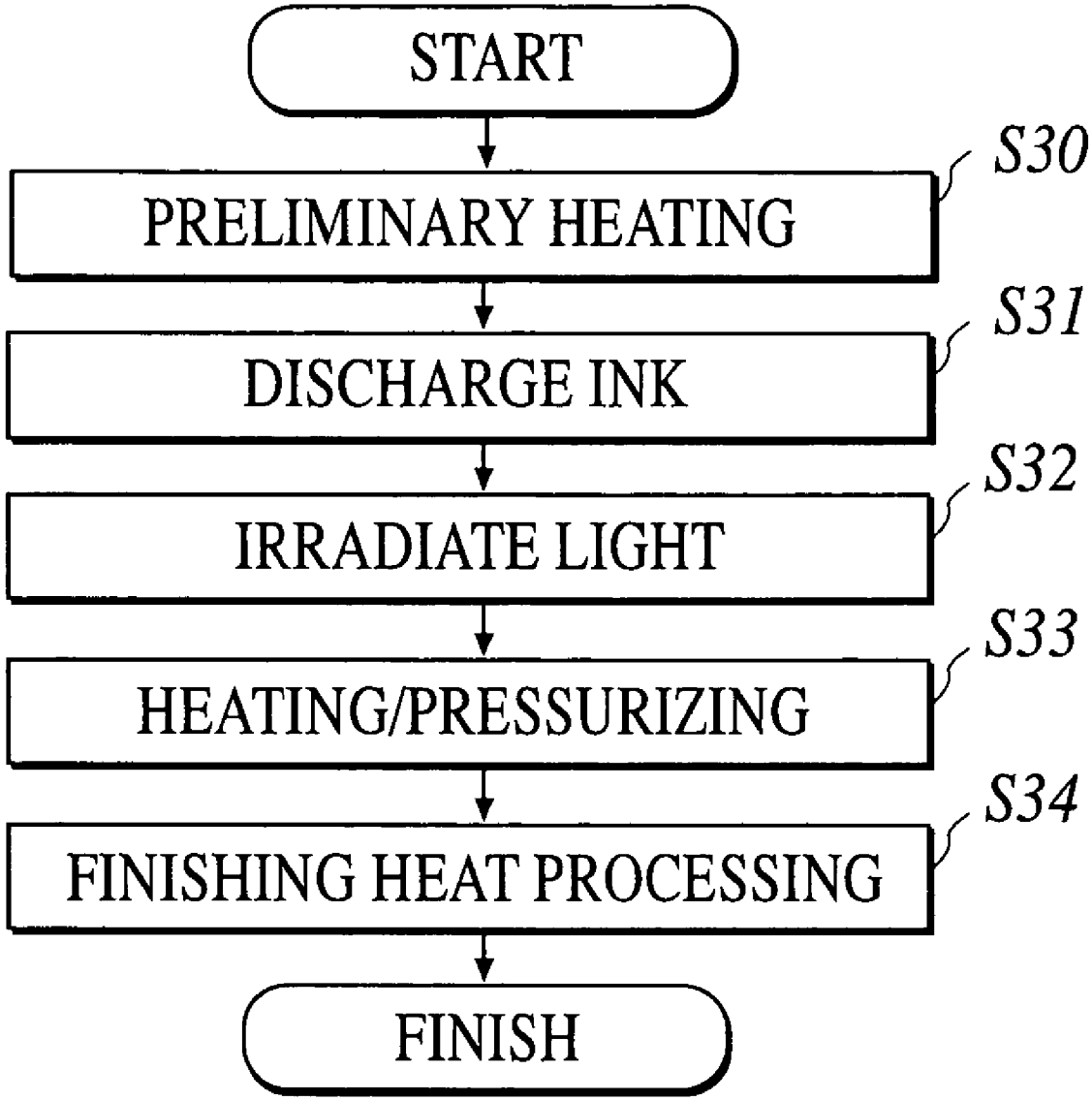
FIG. 17 is a flow chart explaining the operation of a combined configuration of the second and third embodiments.

FIG. 17 is a flow chart explaining the operation of the ink jet recording device that performs both the finishing heat processing and the preliminary heating processing, wherein the recording medium is supplied by a supply section, and a preliminary heating processing is feasible by means of a preliminary heating section similar to that used in the third embodiment (Step S30). Conditions for this preliminary heating processing are as explained above.

The recording medium preliminarily heated is moved to the recording head locating at the downstream side in the moving direction by means of the moving operation of the moving mechanism, and the ink is discharged from the recording head onto the recording medium (Step S31). Following thereto, the recording medium is moved to the light irradiation region of the light source by means of the moving operation of the moving mechanism and exposed to the light irradiation, whereby the curing reaction of the ink is started (Step S32).

The recording medium in which the ink has cured on the recording side is moved to the heating/pressurizing section and is heated and pressurized there (Step S33). Note that it is preferable to control the heating and pressurizing processing so that those processing may be carried out under the optimal condition depending on the situation in accordance with the recording condition performed by the recording head, the type of the recording medium and the like.

Furthermore, the recording medium having been heated and pressurized is moved to a finishing heating section similar to the finishing heating section used in the second embodiment and subjected to a finishing heat processing in order to cure and dehydrate the ink in a short period of time. Conditions for the finishing heat processing in this case are as explained above.

As described above, since the time length required from the adhesion of the discharged ink until the dehydration of the ink is finished is greatly shortened, it may be feasible to realize high printing productivity even employing an ink jet printer using an active energy ray curable ink containing a solvent, particularly water. Furthermore, since pressurizing processing is carried out during the curing and dehydration of the ink in a short period of time, holds on the recording medium that may be caused during the high-speed printing operation and troubles during the moving, which are used to be problematic in the earlier development, are prevented from occurring.

Moreover, by means of carrying out both the preliminary heating processing and the finishing heat processing, more improved high-speed printings may be performed and improved printing productivity may be attained, even though a recording medium in a large size is used.

Figure 18:
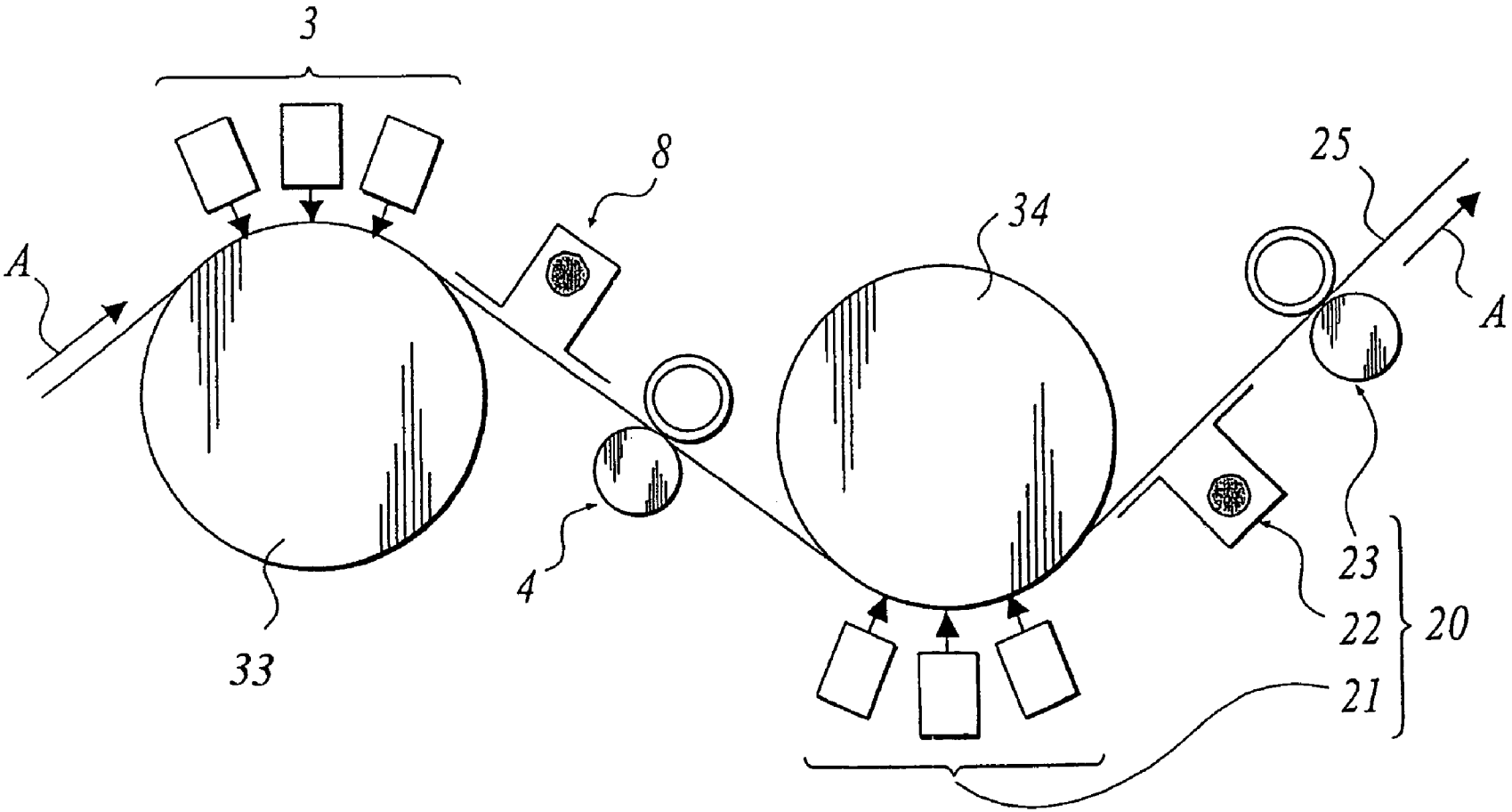
FIG. 18 is a view showing the major portion of a fourth embodiment for the present invention.

FIG. 18 is a schematic view showing the ink jet recording device according to the fourth embodiment, wherein a first platen 33 supporting one side of the recording medium 25 and a second platen 34 supporting the other side thereof are provided, a recording head 3 is provided at a position opposing to the first platen 33, and a light source 8 and a heating/pressurizing section 4 are provided at the downstream side in the moving direction A of the recording medium 25 in this order so that a first recording unit is constituted. A second recording unit 20 is provided at further downstream side of the first recording unit. Specifically, the second platen 34 is provided at the downstream side of the heating/pressurizing section 4 in the moving direction A and a second recording head 21 is provided at a position opposing to the second platen 34. Besides, a second light source 22 and a second heating/pressurizing section 23 are provided at the further downstream side.

The second recording head 21, the second light source 22 and the second heating/pressurizing section 23 have the same configurations and operations of the recording head 3, the light source 8 and the heating/pressurizing section 4 those which constitute the first embodiment, respectively. In addition, the recording medium 25 is one similar to the recording medium 1.

Now, the operation of the ink jet recording device according to the fourth embodiment will be explained in the following.

Printing is carried out by the first recording unit on one side of the recording medium 25, and the recording medium 25, is moved to the second recording unit 20 and is printed there on the other side thereof. Specifically, the recording medium 25 is moved to the recording head 3 in the first recording unit by means of a moving mechanism (not shown), and the recording head 3 discharges the ink onto the recording medium 25. The recording medium 25 is fed to the light source 8, where the discharged ink is exposed to light to cure itself. Then, the discharged ink on the recording medium 25 is cured and dehydrated in a short period of time in the heating/pressurizing section 4, followed by moving to the second recording unit 20. In the second recording unit 20, the ink is discharged onto the surface of the side of the recording medium to which the printing was not performed by the second recording head 21, and the recording medium 25 is moved to the second light source 22, where the discharged ink is exposed to light irradiation to cure itself. Following thereto, the ink is further cured and dehydrated in a short period of time by the second heating/pressurizing section 23. At this stage, the ink is made fixed, and the printing ends.

According to the embodiment described hereinabove, the printing productivity may be improved even in case of carrying out the double-side printing, because it may be feasible to print the respective sides separately in series in the manner of high-speed printing. In addition, even during such a printing operation, occurrence of holds on the recording medium that might be caused during the high-speed printing can be prevented, and the probability of causing troubles during the moving of the recording medium may be diminished.

Figure 19:
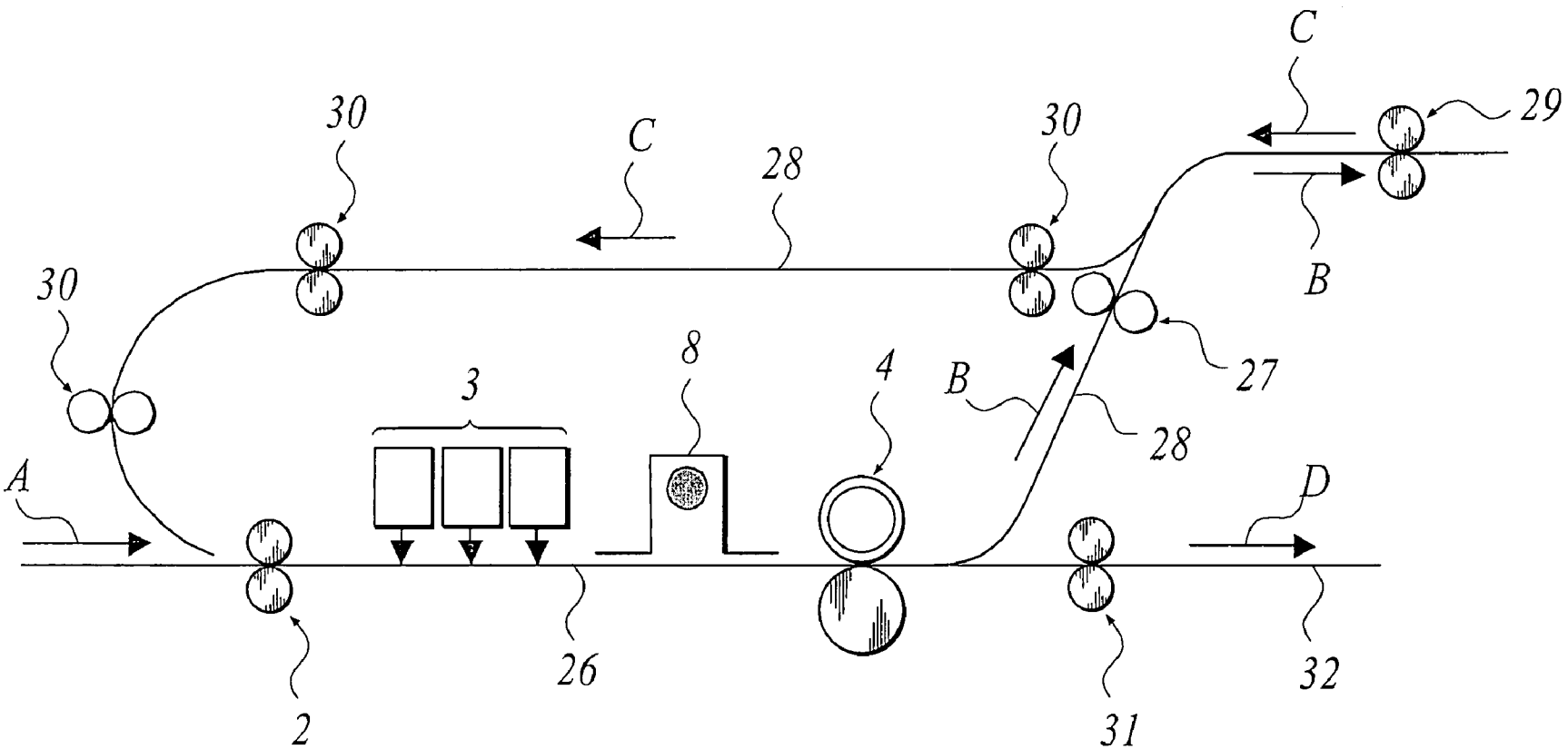
FIG. 19 is a view showing the major portion of a fifth embodiment for the present invention.

FIG. 19 is a schematic view showing the ink jet recording device according to the fifth embodiment, which is suitable when cut papers are used for printing. In the recording unit moving passage 26 that performs printings onto a supplied recording medium, a moving mechanism 2, a recording head 3, a light source 8, and a heating/pressurizing section 4 are disposed along the moving direction A of the recording medium. Besides, the recording unit moving passage 26 is branched at the downstream site from the heating/pressurizing section 4, where one of the branched passage functions as a reverse moving passage 28 and the other functions as an ejection moving passage 32.

In the reverse moving passage 28, a pull-up roller 27 for pulling the recording medium upward from the recording unit moving passage 26 and a contrarotating roller 29 for reversing the moving direction of the moved recording medium may be installed. The recording medium is moved back in the direction of the pull-up roller 27 in the reverse moving passage. The reverse moving passage 28 is branched in the front side of the pull-up roller 27, and moving rollers 30, 30, 30 are disposed in the branched passage, which is jointed to the moving mechanism 2 in the recording unit moving passage 26.

Besides, an ejection roller 31 is installed in the ejection moving passage 32, which is configured so as to eject the recording medium in the ejection direction D.

Note that the moving mechanism 2, the recording head 3, the light source 8 and the heating/pressurizing section 4 described above have the same configurations and operations as those described above for the first embodiment.

Now, the operation of the ink jet recording device according to the fifth embodiment will be explained below.

The recording medium is moved into the recording unit moving passage 26 by the supply section (not shown). In the recording unit moving passage 26, the recording medium is moved to the recording head 3 by means of the moving operation of the moving mechanism 2, where the ink is discharged thereon, then cured by light from the light source 8, and further cured and dehydrated in a short period of time by the heating/pressurizing section 4 to be fixed, whereby the printing operation is completed.

Next, the pull-up roller 27 is actuated to pull recording medium upward onto the reverse moving passage 28 under the state that the ejection roller 31 has been halted, and the recording medium is then moved to the reverse roller 29. At the reverse roller 29, the moving direction of the recording medium is reversed from the forward direction B to the backward direction C, and the recording medium is moved toward the pull-up roller 27 side. At this moment, the moving roller 30 is actuated under the state that the pull-up roller 27 has been halted to move the recording medium to the moving mechanism 2 in the recording unit moving passage 26.

Following thereto, the printing processing onto the side opposite to the previously-printed side is performed by the recording head 3, the light source 8 and the heating/pressurizing section 4 in the recording unit moving passage 26, the ejection roller 31 is then actuated to move the recording medium into the ejection moving passage 32 so that the recording medium is ejected.

According to the embodiment described hereinabove, the printing productivity may be improved even in case of carrying out the double-side printing, because it may be feasible to print the respective sides separately in series in the manner of high-speed printing. In addition, even during such a printing operation, occurrence of holds on the recording medium that might be caused during the high-speed printing can be prevented, and the probability of causing troubles during the moving of the recording medium may be diminished. Moreover, since it is sufficient with a set of a moving mechanism, a recording head, a light source and a heating/pressurizing section, it may be feasible to reduce the number of the components for constituting the ink jet recording device.

Figure 20:
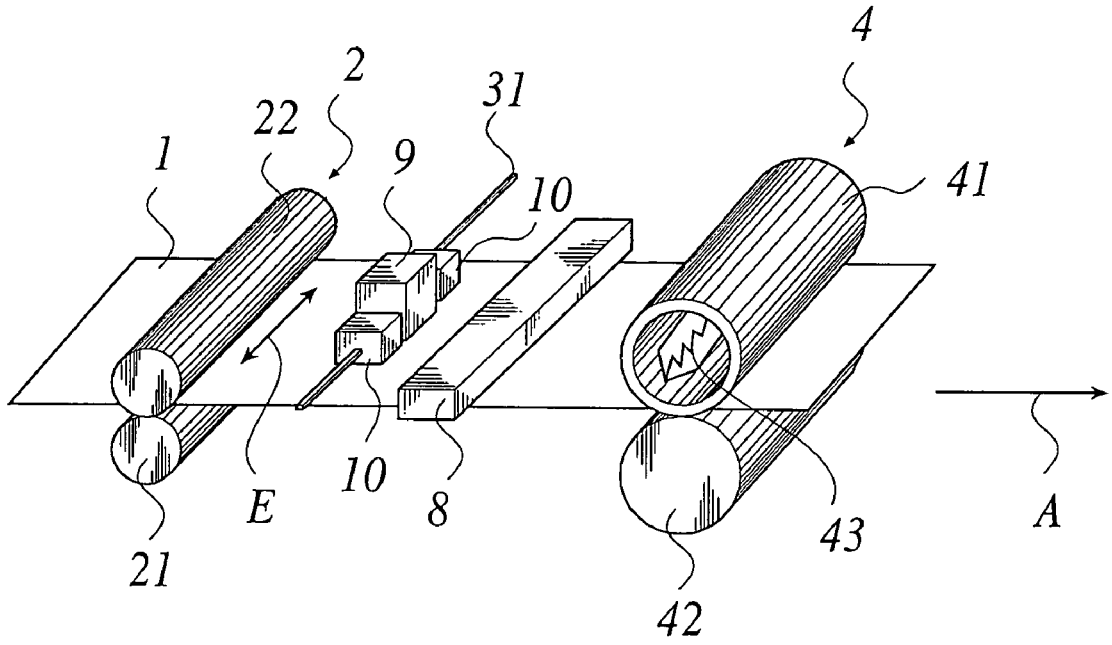
FIG. 20 is a view showing the major portion of a sixth embodiment for the present invention.

FIG. 20 shows the major portion of the ink jet recording device according to the sixth embodiment. The ink jet recording device is installed with a moving mechanism 2 for moving the recording medium in the moving direction A of the recording medium 1, that is the right direction in the drawing, from the downstream side to the recording region of the recording head 9, a recording head 9 to be mounted with ink jet openings for discharging the ink onto the recording medium 1, a light source 8 for irradiating light for curing the ink having been discharged by the recording head 9, a heating/pressurizing section 4, for heating and pressurizing the recording medium.

In the above-defined structure, the recording medium 1, the moving mechanism 2, the light source 8 and the heating/pressurizing section 4 have the same configurations and the operation as those which used in the first embodiment, respectively.

The recording head 9 constitutes the serial-system head that forms images by moving itself in reciprocating motion in the direction across the width of the recording medium 1 on the recording medium 1 and moving the recording medium 1 in the direction orthogonal to the scanning direction of the recording head 9. Specifically, the recording head 9 is configured such that it is arranged at the downstream side of the moving mechanism 2, movably mounted to a scanning guide 31 that is installed in such a manner that the scanning guide 31 extends in the direction across the width of the recording medium 1 and substantially orthogonal to the moving direction A of the recording medium 1, and can be moved by the driving section (not shown) in the major scanning direction E substantially orthogonal to the moving direction A along the scanning guide 31.

Besides, in the recording head 9, a plurality of ink tanks storing various color type of pigment inks, for example, Y (yellow), M (magenta), C (cyan), and K (black), respectively, are included.

A pair of light sources 10 for irradiating light for curing inks is installed on the both sides of the major scanning direction E of the recording head 9.

Now the operation of the ink jet recording device according to the sixth embodiment will be explained in the following.

A recording medium 1 is supplied by a supply section (not shown) and moved to the recording head 9 locating at the downstream side in the moving direction A by the moving mechanism 2. The recording head 9 ejects fixed color types of inks corresponding to the image data at a predetermined timing while moving for major scanning along the scanning guide 31 to record and form a given image on the surface of the recording side of the recording medium 1 in cooperation with the moving of the recording medium 1 operated by the moving mechanism 2 to thereby record and form the predetermined image on the recording side of the recording medium 1. During the operation described hereinabove, the light source 10 performs light irradiation to the discharged ink just after the ink discharged to cure the ink. Furthermore, the recording medium 1 is moved to the light source 8 and exposed to further light irradiation to cure the ink securely.

The recording medium 1 carrying the cure ink on its recording side is moved to the heating/pressurizing section 4 and subjected to the heating and pressurizing processing there. Note that it is preferable to control the heating and pressurizing processing so that those processing may be carried out under the optimal condition depending on the situation in accordance with the recording condition performed by the recording head 3, the type of the recording medium and the like.

Thus, the ink in the images recorded and formed on the recording medium as described above has become a state having been cured and dehydrated in a short period of time and fixed.

As described above, since the time length required from the adhesion of the discharged ink until the dehydration of the ink is greatly shortened, it may be feasible to realize high printing productivity even employing an ink jet printer using an active energy ray curable ink containing a solvent, particularly water. Furthermore, since pressurizing processing is carried out during the curing and dehydration of the ink in a short period of time, holds on the recording medium that may be caused during the high-speed printing operation and troubles during the moving, which are used to be problematic in the earlier development, are prevented from occurring.

Note that, in this embodiment, though a pair of light sources is installed so as to be adjacent to each other in the major scanning direction of the recording head 9 and another light source is installed between the recording head 9 and the heating/pressurizing section 4, only a pair of light sources 10 being adjacent to each other or a single light source 10 may be installed in the major scanning direction of the recording head 9, or only a light source 8 may be installed between the recording head 9 and the heating/pressurizing section 4.

Figure 21:
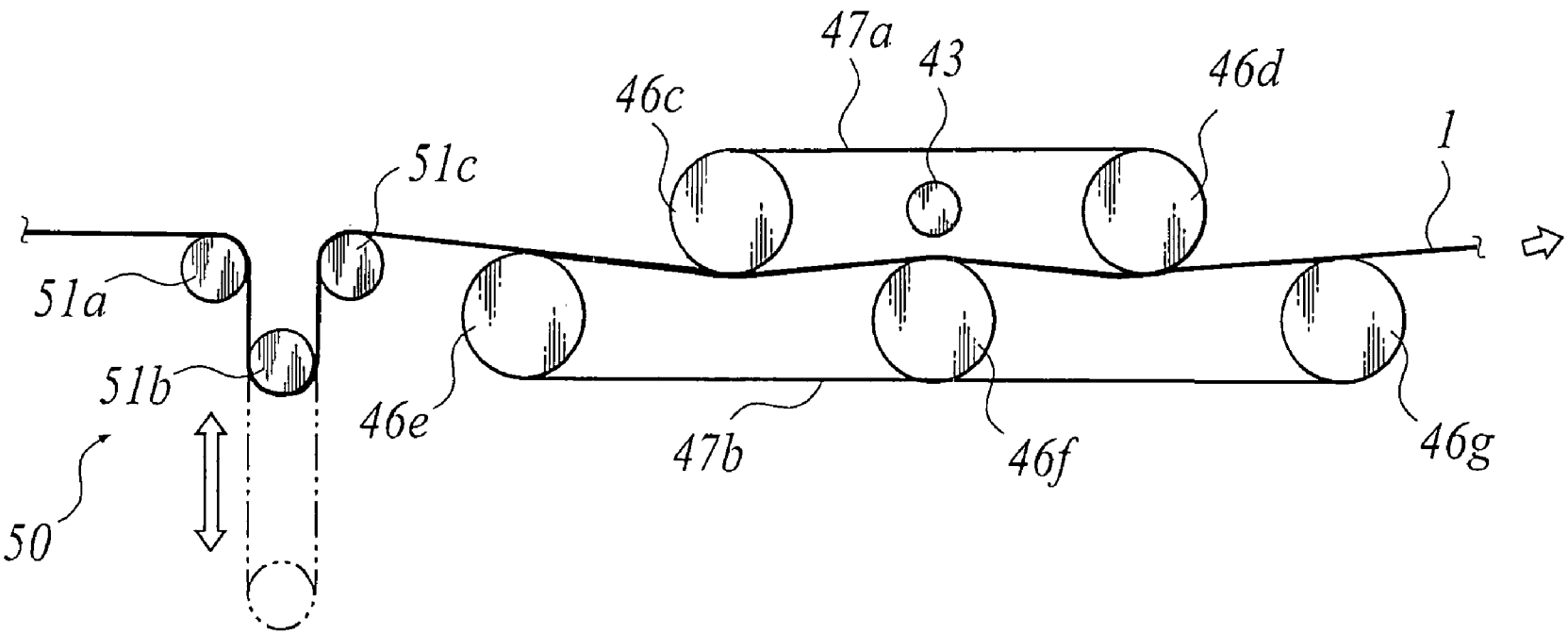
FIG. 21 is a view showing the embodiment in which the accumulator 50 for moving the paper at a constant speed in the heating/pressurizing section.

FIG. 21 is a view showing the embodiment in which an accumulator 50 for moving the paper at a constant speed in the heating/pressurizing section is provided ahead of the embodiment of the heating/pressurizing section shown in FIG. 5.

As described above, the recording medium 1 is inserted between the belt member 47*a* serving as a belt member for heating and the belt member 47*b* serving as a belt member for pressurizing. Further, the roller 46*c* or 46*d* is rotatively actuated and the belt member 47*a* is counterclockwisely actuated to thereby move the recording member 1 in the indicated right direction of the drawing.

Further, the electrical heating element 43 is provided inside the belt member 47*a*. The belt member 47*a* and the belt member 47*b* is are opposed to each other in mutually pressurized state and are simultaneously heated and pressurized during the process of moving the recording medium 1 being held between the belt members 47*a* and 47*b* operated by the actuation of both of these belt members 47*a*, 47*b*.

Further, the accumulator 50 is provided in the upstream side of the belt member 47*a*, 47*b* over the moving direction of the recording member. The accumulator 50 has an accumulator rollers 51*a*, 51*c* for feeding out the recording medium 1, and an accumulator roller 51*b* for adjusting the moving timing. The accumulator roller 51*b* can vertically move by the axis thereof with respect to the moving direction while feeding out the recording medium 1.

The accumulator 51*b* moves in the approximately vertical direction orthogonal to the moving direction of the recording medium if the processing period of time (throughput) took for the image recording (discharging ink, irradiating ultraviolet ray) of the recording medium 1 and the processing period of time (throughput) took for the heating/pressurizing section differ. For example, if the recording medium 1 is intermittently moved by an ink jet recording provided with serial-system, the accumulator roller 51*b* downwardly moves at the moment the recording medium 1 is finished being recorded and is moved and upwardly moves at the moment the moving is stopped. During this period of time, the accumulator rollers 51*a*, 51*b*, 51*c* feed out the recording medium. Meanwhile, in a line-type ink jet recording, the accumulator 50 is applied to thereby absorb the difference of the processing period (throughput) of time took for the image recording (discharging ink, irradiating ultraviolet ray) with respect to the recording medium 1 and the processing period (throughput) of time took for the heating/pressurizing section if the difference presents.

Therefore, even if the recording medium 1 is intermittently moved and if the moving velocity at the time of recording and the timing of the heating/pressurizing processing are lagged, the constant moving velocity at the heating/pressurizing section of the recording medium 1 can be maintained in the heating/pressurizing section. Further, if cut papers are used as a recording member, a stacker section is provided ahead of introducing the recording medium to the heating/pressurizing section to thereby configure an accumulator, and minimize the difference of the processing period (throughput) of time took for the image recording (discharging ink, irradiating ultraviolet ray) with respect to the recording medium 1 and the processing period (throughput) of time took for the heating/pressurizing section if the difference presents.

Further, although the accumulator is applied ahead of the heating/pressurizing section of the embodiment shown in FIG. 5, it can be apparently applied to the other embodiments.

Figure 22:
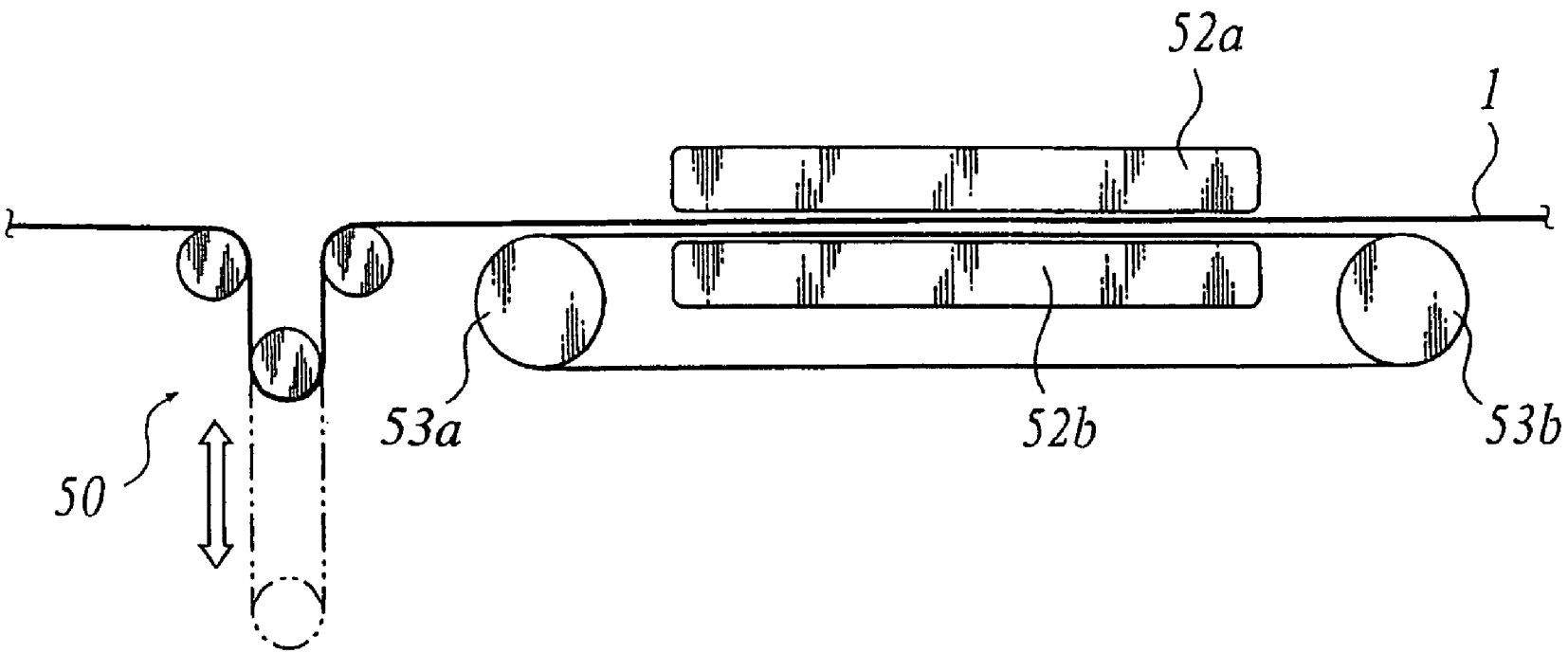
FIG. 22 is a view showing the embodiment in which a pair of heaters is provided as the heating/pressurizing section on two sides of the recording medium.

FIG. 22 is a view showing an embodiment in which a pair of heaters is provided as a heating/pressurizing section on both sides of the recording medium to thereby press it. A pair of heaters 52*a*, 52*b* for pressing is provided so that the recording member is inserted thereto. Further, the rollers 53*a*, 53*b* for moving the recording medium 1 are provided at the gap of the heater 52*a*, 52*b*. The rollers 53*a*, 53*b* are actuated to thereby simultaneously heat and pressurize the recording medium 1 which is moved between the heaters 52*a*, 52*b*.

By use of the embodiment, the recording medium 1 is moved from the accumulator 50 to the heaters 52*a*, 52*b*, pressurized and heated while inserted between the heaters 52*a*, 52*b*, moved between the heaters 52*a*, 52*b*, by rotatively operating the rollers 53*a*, 53*b*. Therefore, the recording medium 1 can be pressurized and heated with a simple structure.

Further, although FIG. 22 shows an example in which the moving velocity of the recording medium 1 is adjusted by using the accumulator 50 before the heating/pressurizing section is carried out, the accumulator 50 may apparently not be necessary.

Figure 23:
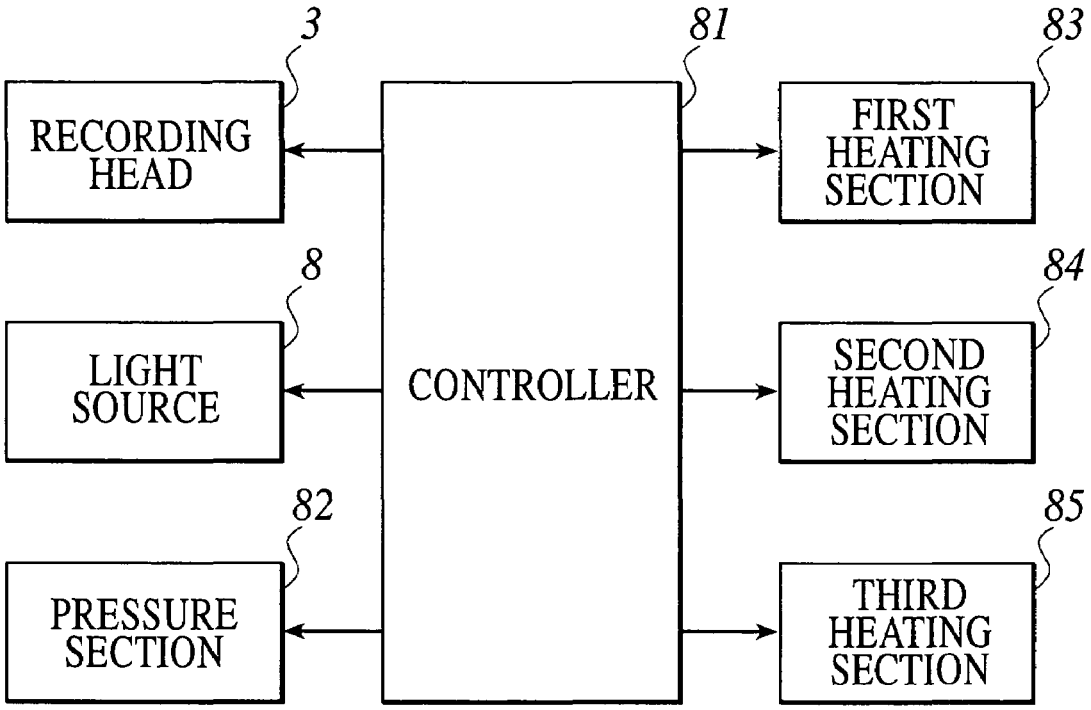
FIG. 23 is a view showing the embodiment in which the timing of the heating/pressurizing processing is controlled by the controller.

FIG. 23 shows a flow chart in which the timing of the heating/pressurizing processing is controlled by the control device. A control device 81 has CPU and the like, and is configured to control the ink discharging operation of the recording head 3, the light irradiating operation of the light source 8 for irradiating ultraviolet rays by which the ink is cured, the pressurizing processing operation of a pressure section 82 for pressurizing the recording member on which the ink exposed to the light irradiation was cured, a first heating section 83 for carrying out the dehydration of the discharged ink on the recording medium, a second heating section 84 for carrying out the finishing heating after the heating processing of the first heating section, and the timing of a third section 85 for carrying out the preliminary heating before the heating of the first heating section.

Further, the first heating section 83 and the pressure section 82 may be integrally configured and convertible to thereby carry out the heating/pressurizing processing with the small number of members.

Further, as shown in, for example, FIG. 4, the pressure section may be configured with a pair of rollers and a heat source may be provided at least one of the belts to thereby carry out the heating/pressurizing processing. By use of such configuration, the heating/pressurizing processing can be carried out while the recording medium is moved. Specifically, the pressure section 82 serves as a moving section for relatively moving the recording medium and the first heating section 82.

Next, the effect of the embodiment is explained.

The recording medium is preliminarily heated by the third heating section 85. The preliminary heating processing condition is described as above. The ink is discharged from the recording head 3 onto the recording medium which was preliminarily heated to thereby carry out the image recording. Further, ultraviolet rays is irradiated to the ink that was discharged on the recording surface and the ink is cured.

Subsequently, the ink that was cured by the first heating section 83 is heated and dehydrated while pressurized by the pressure section 82.

At this time, the control device 81 adjusts the period of time (first predetermined time) from the final ink discharging onto the region to be heated until the first heating section 83 starts the heating processing and the period of time (second predetermined time) of the heating time exposed to the ink on the region.

The first predetermined time is preferably within 0.1 to 120 seconds, meanwhile the second predetermined time is preferably 0.1 to 10 seconds. In the short first and second predetermined time, it is difficult to effectively dehydrate the ink because the heating processing is carried out with the ink insufficiently cured. Otherwise in the long first and second predetermined time, it may undermine the printing productivity and cause flix.

Further, although the first and second predetermined time are fixed so as to simplify the operation of the control device 81, it may changed in accordance with the recording condition of image and the type of recording medium. The heating/pressurizing processing can be carried out with an optimum condition in accordance with the recording condition and the recording medium by properly changing them.

Further, although the heating processing of the first heating section 83 and the pressurizing processing of the pressure section 82 are simultaneously or separately carried out, it is preferable that at least a part thereof is overlapped in view of the effective heating/pressurizing processing.

Therefore, the recording medium that was heated and pressurized is subjected to the finishing heating processing by the second heating section 84 to thereby completely dehydrate the ink on the recording surface.

Now, the inks usable in the embodiments described above will be explained below.

The ink to be selected must be curable in response to light irradiation, preferably to ultraviolet ray irradiation, and moreover contains water and an organic solvent. As the organic solvent, a water-soluble solvent is preferably used. Further, a mixed ink comprising water and a water-soluble solvent is also suitably used. In particular, the ink containing water as the solvent is desirable in view of the environmental and safety issues.

Preferably, the above-mentioned water-base ink further contains a water-soluble polymerizable composition and a polymerization initiator and moreover a photo-induced polymerization initiator.

Even though the non-volatile water-base ink as described above is used, the realization of the high-speed printing aiming at improving the printing productivity is feasible. In addition, since the addition of the photo-induced polymerization initiator accelerates the curing reaction of the ink in response to light irradiation from the light source on the recording medium, the high-speed printings can be operated more easily.

The water-base ink for ink jet use suitably used in the present invention will now be explained in the following.

Polymerizable Composition

The polymerizable compositions usable in the present invention are compositions each including ethylene-like unsaturated bonds capable of free-radical polymerization. Any composition as far as it contains at least one ethylene-like unsaturated bond capable of free-radical polymerization in the molecule may be used. A composition having a chemical form of monomer, oligomer, polymer and the like falls within the scope of the polymerizable compositions described herein. The free-radical polymerizable composition may be used solely or in combination of two or more thereof with an arbitrary combining ratio in order to improve a targeted property.

Among the compositions including ethylene-like unsaturated bonds capable of free-radical polymerization usable for the present invention, the compositions that contain moreover at least one carboxylic group are preferably used. Such compositions include:

(1) Products of the reaction of dibasic anhydride and hydroxyl-containing acrylate or metacrylate: One of these products includes products of a reaction of succinic anhydride, orthophthalic anhydride, maleic anhydride or the like with 2-hydroxyethylmetacrylate or 3-chloro-2-hydroxypropylmetacrylate.

(2) Compositions produced by reacting a dibasic anhydride with secondary hydroxyl group of an acrylate of epoxy resin: One of these products includes bisphenol-type epoxy resins, that is, Epicoat 828 and Epicoat 1001 (Trade names; Manufactured by Yuka Shell Epoxy), polyhydric alcohol aliphatic epoxy resin, that is, Deconal (Trade name; Manufactured by Nagase Kasei), and compositions produced by reacting succinic anhydride or maleic anhydride with the remanent or newly-produced hydroxyl groups after reacting an acrylate with, for example, 1,4-butanediol diglycidyl ether, trimethylol propanediglycidyl ether, pentaerythryl triglycidyl ether, or a cyclic aliphatic epoxy resin, that is, Celoxide (Trade name; Manufactured by Dicel Chemical) or the like.

(3) Compositions produced by reacting a dibasic anhydride with a polyhydric alcohol ester of acrylic acid or etacrylic acid: One of these compositions includes compositions produced by reacting succinic anhydride or maleic anhydride with a glycol ester or a polyethylene glycol ester of an acrylate. The glycol or polyethylene glycol to be used in the reaction described above is preferably the one having a molecular weigh in a range of 600 or less.

(4) Water-soluble urethane acrylates and metacrylates each having carboxyl side chains in the molecular chains: The synthesis of oligomers that is an ultraviolet curable resin is publicly known. However, for synthesizing oligomeric composition having carboxyl side chains, a polybasic acid represented by trimellitic anhydride or a composition containing two hydroxyl groups and one carboxyl group in one molecule represented by dimethylolpropionic acid and the like is used in the middle of the oligomer synthetic reaction.

Any of the compositions exemplified in the above (1) to (4) is neutralized with a base to become a composition easily soluble in water. Specific examples of the base include ammonia, methylamine, ethylamine, dimethylamine, diethylamine, n-butylamine, di-n-butylamine, trimethylamine, ethylenediamine, diethylenetriamine, triethylenetetramine, tetraethylenepentamine, propylenediamine, ethanolamine, hexylamine, laurylamine, diethanolamine, triethanolamine, morpholine, piperidine, propylamine, isopropylamine, isobutylamine, NaOH, LiOH, KOH and the like. Besides, in case for providing the ultraviolet curable composition with chemical resistance against an etching solution and for making feasible to strip the ultraviolet curable composition with a strong alkali from the substrate, the base to be used is preferably an organic base, in particular a base with high volatility, of which boiling point under normal pressure is 190° C. or lower.

In the present invention, it is considered that the use of a water-soluble polymerizable composition is preferable. Further, it is also considered preferable to use a water-soluble polymerization initiator in addition to the polymerization initiator. As such a water-soluble polymerizable composition and water-soluble polymerization initiator, the ones described in JP Tokukai 2002-187918 can be given, for example.

Coloring Agent

Pigments and dyes having been conventionally used are usable as the coloring agent for the present invention. Examples of the pigment include, for example, various organic chromatic pigments, such as phthalocyanine pigments, azo-pigments, quinacridone pigments, dioxanedine pigments, and diketopyrrolopyrrole pigments, and inorganic pigments, such as carbon black, titanium white, silica, mica and zinc oxide.

The pigments enumerated below may be fitly used as the organic pigment. As yellow pigments, for example, pigment yellow 1, 2, 3, 12, 13, 14, 16, 17, 55, 73, 74, 75, 83, 93, 95, 97, 98, 109, 110, 114, 128, 138, 139, 150, 151, 154, 155, 180, etc. can be given.

As magenta pigments, for example, pigment red 5, 7, 12, 48 (Ca), 48 (Mn), 57:1, 57 (Sr), 57:2, 122, 123, 146, 168, 184, 202, 221, 238, pigment violet 19, etc. can be given.

As cyan pigments, for example, pigment blue 1, 2, 3, 16, 22, 60, 15:2, 15:3, 15:4, vat blue 4, 60, etc. can be given.

When a pigment is used as the coloring agent, it is preferable to use a dispersion of an aqueous pigment in which the pigment is uniformly dispersed in an aqueous carrier and to admix the dispersion with the aqueous photo-setting resin compound according to the present invention. As the aqueous pigment dispersion, it is preferable to use an aqueous pigment dispersion in which the pigment is stably dispersed with anionic functional groups. For example, aqueous gravure ink, aqueous pigment dispersions for writing instrument use, conventionally-known pigment dispersions for ink jet ink use and so on, those which are stable in a nonionic system or an anionic system, may be directly used.

Examples of the pigment dispersion containing anionic dissociating groups and dispersed with the use of an alkali- and water-soluble polymer are disclosed in, for example, JP Tokukaihei 5-247392 and 8-143802. Further, the pigment dispersion dispersed with the use of a surface active agent having anionic dissociating groups is disclosed in JP Tokukaihei 8-209048. Still further, the pigment dispersion having been capsulated with a polymer and dispersed by an application of anionic dissociating groups to the surface is disclosed in JP Tokukaihei 10-140065, 9-316353, 9-151342, 9-104834 and 9-031360. Still further, the pigment dispersion in which anionic dissociating groups are chemically reacted to bond them to the surface of a pigment to thereby disperse the pigment is disclosed in U.S. Pat. Nos. 5,837,045 and 5,851,280.

The basic factors particularly required for the pigment dispersion to be suitably used for the ink for ink jet recording use are that the pigment can be dispersed with an aqueous carrier, that the particle size distribution of the dispersion falls within a range of from 25 nm to 350 nm in the average particle size, that the viscosity of the finished ink is adjustable to a range that does not affect the jetting performance of the ink, and that the dispersion has satisfactory compatibility with a compound essential for preparing the ink to be ultraviolet curable.

When the average particle size of the pigment particles is prepared in a range of approximately 25 nm to 350 nm, printed products considered as being sufficiently transparent may be produced under a condition of less scattering, although the sufficiency of the transparency depends on the use of the printed products, since the average size is rendered to be sufficiently smaller than the wavelength of visual light.

When a dye is used as the coloring agent, unlike the case where the pigment was used as described above, it is not possible to use the coloring agent under a condition where no discoloration due to ultraviolet rays occurs, that is, more or less discoloration of the dye may result in. For this reason, when a dye is applied as the coloring material for the ink, it is preferable to use the so-called azo gold-containing pigment that forms complexes with metal ions because the discoloration due to light may be less. However, if the level of the discoloration is not an important factor, even water-soluble dyes having been commonly used may be at least an ink compound. Based on the above premise, the following compounds are applicable as dyes to the effect they give colors of process colors.

As yellow dyes, for example, acid yellow 11, 17, 23, 25, 29, 42, 49, 61 and 71, direct yellow 12, 24, 26, 44, 86, 87, 98, 100, 130, 132, 142, etc. can be given.

As magenta red dyes, for example, acid red 1, 6, 8, 32, 35, 37, 51, 52, 80, 85, 87, 92, 94, 115, 180, 254, 256, 289, 315 and 317, direct red 1, 4, 13, 17, 23, 28, 31, 62, 79, 81, 83, 89, 227, 240, 242, 243, etc. can be given.

As cyan dyes, for example, acid blue 9, 22, 40, 59, 93, 102, 104, 113, 117, 120, 167, 229, 234 and 254, direct blue 6, 22, 25, 71, 78, 86, 90, 106, 199, etc. can be given.

The aqueous photo-setting ink according to the present invention may be added with a solvent component other than water. The solvent component is added for the purposes of giving non-volatility to the ink, reducing the viscosity and moreover giving wetting property to the base material for printing, etc. When the printing is carried out onto a non-absorbent base material, it is preferable not to incorporate the solvent component into the ink, but to incorporate water only so as to let the whole polymerizable components to cure into the solid state.

When the solvent component is added into the ink at a concentration of 10% or more, it is required for the object to be printed (a material to which a recording is made) that forms images to furnish with a given absorption in connection with the strength of the eventually obtainable films of the ink. That is, when the printing is carried out with the use of an aqueous gravure ink, it is a customary procedure to use a recording material provided with a given wetting and infiltration property and to carry out forcible dehydration. Similarly, with respect to the ink according to the present invention, when the solvent component is added into the ink at a concentration of 10% or more, it is preferable to apply a preliminary processing to the object to be printed for giving receptible property to an aqueous ink and moreover to apply natural or forcible dehydration processing following to the curing of the ink with ultraviolet rays. Since each of various types of polymerizable substances disclosed in the present invention has a given moisture retention (a property to control evaporation of water and to absorb water) by itself, it is possible to form an ink from which a solvent is completely eliminated. In such a case, such measures as capping, sucking of fresh ink at starting printing, discharging without ink and so on may be taken in order to secure reliability of the printing in the practical level.

In the following, examples of the organic solvent usable for the aqueous ink specified in the present invention, those which evaporate relatively easily, will be enumerated. Any arbitrarily selected organic solvent from these enumerated organic solvents may be used for the ink to be used in the present invention. The examples include, glycol ethers, such as ethylene glycol monomethyl ether, ethylene glycol monoethyl ether, ethylene glycol monoisopropyl ether, ethylene glycol monoallyl ether, diethylene glycol monomethyl ether, diethylene glycol monoethyl ether, triethylene glycol monomethyl ether, triethylene glycol monoethyl ether, propylene glycol monomethyl ether and dipropylene glycol monomethyl ether, univalent alcohols and the like.

And if required, other additives including a polymerization inhibitor, a surface active agent, an additive for leveling, a matting agent, a polyester resin for adjusting the properties of the film, a polyurethane resin, a vinyl resin, an acryl resin, a rubber resin, a wax and the like may be added into the ink.

In the water-base curable ink used in the present invention, it is preferable to control the concentrations of a catalyst and a polymerizable substance contained in the ink in accordance with the absorption property of the contained coloring agent. As to the blending ratio, the volume of either water or a solvent is fixed to a range of 3 to 68% by mass, and preferably 50 to 65% by mass. Besides, the content of the polymerizable composition in the ink is fixed to a range of 5% by mass or more, and preferably 10 to 90% by mass with respect to the whole mass of the ink. The amount of the photo-induced polymerization initiator is fixed to a range of 0.01 to 15% by mass, and preferably 0.1 to 10% by mass, with respect to the mass of the polymerizable composition.

When a pigment is used as the coloring agent for the ink, the net concentration of the pigment in the ink is fixed in a range of approximately 0.3 to 15% by mass with respect to the whole mass of the ink. The coloring performance of the pigment depends on the state of the dispersion of the pigment particles, and when the concentration of the pigment in the ink is in a range of about 0.3 to 1% by mass, it will be the range for the ink to be used as an ink giving a pale color. When the concentration is fixed to more than that level, the ink gives a color with a density normally used for coloring.

Besides, the composition ratio of the ink for ink jet use used in the present invention is determined so that the viscosity of the ink compound is adjusted by using the pigment dispersion to a range of 10 to 500 mPa·s at 25° C. and to a range of 1 to 30 mPa·s when the ink is heated up to a temperature of 35° C. or higher.

By taking measures of raising the viscosity at room temperature, it may be feasible to prevent an absorptive recording medium from being penetrated by the ink, to reduce the amount of the uncured monomers and odor and to diminish the exudation around the dots at the time the ink was discharged onto the recording medium to thereby improve the quality of the printed images. Furthermore, since dots may be formed on different base materials each having different surface tension, respectively, it is feasible to attain images with the similar qualities on the different base materials. Besides, the exudation prevention effect will be insufficient if the viscosity is less than 10 mPa·s, while it could be problematic for the supply of the ink solution if the viscosity is greater than 500 mPa·s.

Hence, the viscosity of the ink compound preferably falls within a range of 1 to 30 mPa·s in order to secure the stable attitude for discharging ink.

All of the various types of polymerizable substances contained in the aqueous photo-setting ink according to the present invention as described above have acidic functional groups, respectively. Therefore, in order to dissolve them in water, respectively, it is desirable to render them in the state of having been neutralized and dissociated with a base. Therefore, the polymerizable substance is normally adjusted from neural to basic with an alkali metal, alcohol amine, ammonia, morpholine, piperidine or the like and is then dissolved in water. At this time, it is recommendable to avoid the use of a composition having primary and/or secondary amino groups since there is a possibility to result in the addition of the polymerizable substance to the double bonds (Michael addition) even in the aqueous solution. Since this reaction is inhibited by polar groups, only the very limited reaction can proceed as far as in the presence of a large volume of water. Therefore, how much degree to avoid the use of the composition having primary and/or secondary amine groups depends on the guaranteed shelf life of the compound.

The raw materials used for the ink may be mixed in any order. However, it is preferable to prepare the pHs of all of the materials in advance so as to fall within a range from neutral to basic in order to secure the stability of the materials at the time of mixing. During the mixing, it is preferable to immediately stir the mixture to avoid the mixture from being kept in a non-homogenous state for a long time. When the pigment dispersion is used as a coloring material, it is preferable to further stir the mixture thoroughly following to the mixing in order not to impair the uniformity.

The present invention will now be explained further in detail with referring Examples in the following. However, it should be noted that the present invention is not limited to these Examples.

Reference Example

Preparation of Water-base Photo-setting Ink

Pigment dispersions set forth in Table 1 are used to prepare the inks as described in the following.

TABLE 1

| Dispersion | Pigment Contained (C.I. name) | Pigment Concentration (%) | Average Particle Size (nm) | Dispersing Agent Used |
|---|---|---|---|---|
| Yellow Dispersion 1 | pigment yellow 155 | 16 | 189 | Acrylic alkali-soluble type aqueous polymer |
| Yellow Dispersion 2 | pigment yellow 13 | 18 | 120 | Styrene/acrylic acid/ethylene acrylate copolymer |
| Yellow Dispersion 3 | pigment yellow 93 | 15 | 130 | Phosphoric acid-based surface active agent |
| Magenta Dispersion 1 | pigment red 122 | 19 | 164 | Acrylic alkali-soluble type aqueous polymer |
| Magenta Dispersion 2 | pigment red 146 | 14 | 150 | Phosphoric acid-based surface active agent |
| Cyan Dispersion 1 | pigment blue 15:3 | 16 | 106 | Acrylic alkali-soluble type aqueous polymer |
| Cyan Dispersion 2 | pigment blue 15:3 | 14 | 134 | Styrene/acrylic acid/ethylene acrylate copolymer |
| Black Dispersion 1 | pigment blue 7 | 19 | 113 | Acrylic alkali-soluble type aqueous polymer |
| Black Dispersion 2 | pigment blue 7 | 20 | 103 | Styrene/acrylic acid/ethylene acrylate copolymer |

| Yellow Ink 1 | |
|---|---|
| Yellow Dispersion 1 | 25.0 parts by mass |
| Polymerizable Compound 1 (Exemplified Compound A3-1) | 15.0 parts by mass |
| Photo-induced Polymerization Initiator 1 (Compound shown below) | 2.0 parts by mass |
| Water | 62.0 parts by mass |
| Triether amine | Appropriately (Amount required to adjust to pH 8.5) |

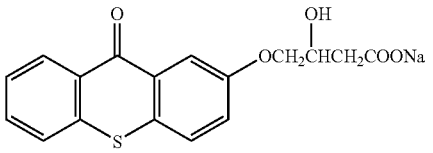

The polymerizable composition and the photo-induced polymerization initiator are respectively added in the form of the aqueous solution having been adjusted to a pH of 8.0 with triether amine in advance so that the concentration thereof come to the values described above. In addition, following to blending all of the components described above, the ink solution was finally adjusted to a pH of 8.5 with the use of triether amine.

| Magenta Ink 1 | |
|---|---|
| Magenta Dispersion 1 | 21.0 parts by mass |
| Polymerizable Compound 1 | 15.0 parts by mass |
| Photo-induced Polymerization Initiator 1 | 2.0 parts by mass |
| Water | 62.0 parts by mass |
| Triether amine | Appropriately (Amount required to adjust to pH 8.5) |

The polymerizable composition and the photo-induced polymerization initiator are respectively added in the form of the aqueous solution having been adjusted to a pH of 8.0 with triether amine in advance so that the concentration thereof come to the values described above. In addition, following to blending all of the components described above, the ink solution was finally adjusted to a pH of 8.5 with the use of triether amine.

| Cyan Ink 1 | |
|---|---|
| Cyan Dispersion 1 | 25.0 parts by mass |
| Polymerizable Compound 1 | 15.0 parts by mass |
| Photo-induced Polymerization Initiator 1 | 2.0 parts by mass |
| Water | 58.0 parts by mass |
| Triether amine | Appropriately (Amount required to adjust to pH 8.5) |

The polymerizable composition and the photo-induced polymerization initiator are respectively added in the form of the aqueous solution having been adjusted to a pH of 8.0 with triether amine in advance so that the concentration thereof come to the values described above. In addition, following to blending all of the components described above, the ink solution was finally adjusted to a pH of 8.5 with the use of triether amine.

| Black Ink 1 | |
|---|---|
| Black Dispersion 1 | 26.0 parts by mass |
| Polymerizable Compound 1 | 15.0 parts by mass |
| Photo-induced Polymerization Initiator 1 | 2.0 parts by mass |
| Water | 57.0 parts by mass |
| Triether amine | Appropriately (Amount required to adjust to pH 8.5) |

The polymerizable composition and the photo-induced polymerization initiator are respectively added in the form of the aqueous solution having been adjusted to a pH of 8.0 with triether amine in advance so that the concentration thereof come to the values described above. In addition, following to blending all of the components described above, the ink solution was finally adjusted to a pH of 8.5 with the use of triether amine.

The inks prepared as described above were used to conduct recording tests. The recording speed was fixed at 5 m/h and 10 m/h, respectively.

EXAMPLE 1

The ink jet printer provided with a serial-system head shown in FIG. 20 was used. Four color inks prepared as described above were respectively placed into ink tanks formed in the recording head 9 and an ultraviolet radiation lamp as the light source 10 was arranged on both sides of the recording head to construct a carriage.

A variable piezo-type head with the nozzle pitch of 360 dpi and the liquid drop size in a range of 4 to 28 pl was used as the ink jet nozzle to be equipped to the recording head 9. At 360 dpi, the liquid drop size of 4 to 28 pl per a pixel was used. Note that the dpi denotes the number of dots per 2.54 cm in the present invention. At recording, a method of one time interleaving capable of exerting the highest printing productivity was employed.

The used ultraviolet lamp arranged on the carriage was a mercury lamp having the main peak at 365 nm, and control of the irradiation intensity (mW) was conducted by properly controlling input electrical energy.

As the recording material, quality papers were used.

The carriage speed was fixed at two modes of 200 mm/min. and 600 mm/min. to evaluate the dehydration performance of the inks and occurrence of holds on the recording material. The evaluation was conducted based on the following criteria.

[Table 2]

Table 2: Evaluation of Dehydration Performance Dehydration performance: The recording side of the recording medium was rubbed with a cloth just after the dehydration process or the light irradiation process, and the adhesion of the ink and the deformation of images were checked.

A: No adhesion of ink

B: Slight adhesion of ink at solid density portions

C: Adhesion of ink and deformation of images observed

[Table 3]

Table 3: Evaluation on Occurrence of Holds

Holds

A: No hold

B: Slight holds recognized

C: Holds observed

TABLE 4

| | Example | | | |
|---|---|---|---|---|
| Heating and dehydration process | Temperature (° C.) | Recording speed (mm/min) | Dehydration performance | Holds |
| None | — | 200 | A | B |
| None | — | 600 | B | B |
| Warm air | 80 | 600 | A | C |
| Drum | 80 | 600 | A | A |
| Belt | 120 | 600 | A | A |

As shown in Table 4, according to the present invention, no occurrence of holds was observed, and the good dehydration performance under high-speed printing was attained.

Furthermore, even when the printing on the reverse side of the recording medium having been already recorded on the right side according to the present invention was carried out, the printing was successfully performed without jam troubles due to the holds and abrasion by the recording head.

What is claimed is:

1. An image recording device, comprising:

a recording head which discharges an ultraviolet-ray curable ink, which is cured as irradiated with ultraviolet rays;

an ultraviolet light source which generates ultraviolet rays to cure the ultraviolet-ray curable ink;

a first heating section which heats the ultraviolet-ray curable ink on a recording medium after an irradiation of the ultraviolet rays;

a second heating section which heats the recording medium before a heating process of the first heating section;

a third heating section which heats the recording medium after a heating process of the first heating section;

a pressure section which pressurizes the recording medium after an irradiation of the ultraviolet rays; and a controller which controls the first heating section to start heating the ultraviolet-ray curable ink on the recording medium after the last discharge of the ink to an arbitrary area on the recording medium, a first predetermined time between the last discharge and the starting heat is predetermined, and controls the first heating section to heat the ultraviolet-ray curable ink within a second predetermined time in a range between 0.1 and 10 seconds.

2. The image recording device of claim 1, wherein the first predetermined time is in a range between 0.1 and 120 seconds.

3. The image recording device of claim 1, wherein the controller controls a heat quantity, which is applied to the ink by the heating section, in accordance with kinds of recording medium to be recorded.

4. The image recording device of claim 3, wherein the controller controls the second predetermined time in accordance with kinds of recording medium to be recorded.

5. The image recording device of claim 1, wherein the controller controls the first predetermined time in accordance with kinds of recording medium to be recorded.

6. The image recording device of claim 1, wherein the controller controls a heat quantity, which is applied to the ink by the heating section, in accordance with recording conditions.

7. The image recording device of claim 6, wherein the controller controls the second predetermined time in accordance with recording conditions.

8. The image recording device of claim 7, wherein the recording condition includes at least one of a type of the ink, period of time required for discharging the ink from the recording head, and a discharge amount of the ink from the recording head.

9. The image recording device of claim 6, wherein the recording condition includes at least one of a type of the ink, period of time required for discharging the ink from the recording head, and a discharge amount of the ink from the recording head.

10. The image recording device of claim 1, wherein the controller controls the first predetermined time in accordance with recording conditions.

11. The image recording device of claim 10, wherein the recording condition includes at least one of a type of the ink, period of time required for discharging the ink from the recorded head, and a discharge amount of the ink from the recording head.

12. The image recording device of claim 1, wherein the first heating section is used as the pressure section.

13. The image recording device of claim 1, wherein a heating process of the first heating section and a pressurize process of the pressure section are overlapped.

14. The image recording device of claim 1, further comprising:

a moving section which moves the recording medium relative to the first heating section.

15. The image recording device of claim 14, wherein the moving section includes:

a pair of rollers which moves the recording medium to the first heating section, wherein one of the rollers is used as the heating section, and the other is used as the pressure section.

16. The image recording device of claim 14, wherein the moving section includes:

a roller and a belt which move the recording medium to the first heating section, wherein one of the roller and the belt is used as the heating section, and the other is used as the pressure section.

17. The image recording device of claim 14, wherein the moving section includes:

a pair of belts which moves the recording medium to the first heating section, wherein one of the belts is used as the heating section, and the other is used as the pressure section.

18. The image recording device of claim 1, wherein the ultraviolet-ray curable ink is a water-base ink.

19. The image recording device of claim 1, wherein the second heating section heats the recording medium before a recording process of the recording head.

20. The image recording device of claim 1, wherein a heating temperature of the first heating section is given as $T0 \pm \Delta T$, where $T0$ is within a range of 50° C. to 200° C., and $\Delta T$ is within a range lower than 10° C.

* * * * *